US005681448A

United States Patent [19]

Uchiyama et al.

[11] Patent Number: 5,681,448

[45] Date of Patent: Oct. 28, 1997

[54] ELECTROCHEMICAL PROCESS AND SYSTEM FOR ETCHING SEMICONDUCTOR SUBSTRATES

[75] Inventors: Makoto Uchiyama, Miura; Hidetoshi Nojiri, Yokohama; Yasukazu Iwasaki, Yokosuka., all of Japan

[73] Assignee: Nissan Motor Co., Ltd., Kanagawa, Japan

[21] Appl. No.: 578,920

[22] Filed: Dec. 27, 1995

[30] Foreign Application Priority Data

Dec. 27, 1994 [JP] Japan ..... 6-324233
Nov. 30, 1995 [JP] Japan ..... 7-312025

[51] Int. Cl.[6] ..... C25F 3/12; C25F 7/00

[52] U.S. Cl. ..... 205/656; 205/672; 204/224 M; 204/237

[58] Field of Search ..... 205/656, 672; 204/224 M, 237

[56] References Cited

U.S. PATENT DOCUMENTS 3,188,284 6/1965 Flinn et al. ..... 205/672 X
5,501,787 3/1996 Bassous et al. ..... 205/656

FOREIGN PATENT DOCUMENTS 4-157183 5/1989 Japan .

OTHER PUBLICATIONS

"Application of Preferential Elecrtochemical Etching of Silicon to Semiconductor Device Technology" Journal of Electrochemical Society, vol. 177, p. 959, Jul. 1970.

"Novel Electrochemical Micro-Machining and its Application for Semiconductor Acceleration Sensor IC" Transducers 1987, pp. 112–115 (no month).

"Concerning Safety of Hydrazine Aqueous Solution" Feb. 26, 1990, Nippon Carbide Kogyo Kabushiki-Kaisha, Japan.

"Newly Edited Electrochemical Measurement Method" edited by Electrochemical Association, Kenyu-sha, Japan 1988 (no month).

"Chemical Engineering Handbook", the chapter Stirring and Mixing, p. 1305, Maruzen, Japan, 1978 (no date).

"Electrochemical Handbook" Fifth Chapter, Fourth edition, 1985 (no month).

"Chemical Engineering Handbook" Revised Fifth Edition, pp. 117–118, Maruzen, Japan (no month).

"Study of Electrochemical Etch-Stop for High-Precision Thickness Control of Silicon Membranes" IEEE Transactions of Electron Devices, vol. 36, No. 4, Apr. 1989 pp. 663–669.

"Chemical Engineering Handbook", Revised Fifth Edition, pp. 893–895; particulary Table 20.0, Maruzen 1988, Japan (no month).

"Newly Edited Electrochemical Measurement Method" Electrochemical Association, Kenyusha, Japan, 1988, pp. 58–59 (no month).

"Electrochemically Thinned N/N + Epitaxial Silicon-Method and Applications" Journal of Electrochemical Society vol. 118, 1971, p. 1240 (no month).

(List continued on next page.)

*Primary Examiner*—Donald R. Valentine
*Attorney, Agent, or Firm*—Lowe, Price, LeBlanc & Becker

[57] ABSTRACT

An electrochemical etching process carried out in an etching system including an electrolysis vessel which is provided thereinside with facing wall surfaces defining therebetween an etching solution flow region. A semiconductor substrate to be etched and a counter electrode are mounted respectively on the facing wall surfaces. A flow stream generating section for the etching solution is formed separate from the etching solution flow region and includes a device for generating the flow stream of the etching solution. The flow stream generating section is connected to the etching solution flow region in such a manner that the etching solution flow in a direction generally parallel with the facing wall surfaces inside the electrolysis vessel. An electric potential is applied between the semiconductor substrate and the counter electrode to accomplish an electrochemical etching on the semiconductor substrate.

45 Claims, 24 Drawing Sheets

OTHER PUBLICATIONS

"Diaphragm Thickness Control in Silicon Pressure Sensors Using an Anodic Oxidation Etch–Stop" Journal of Electrochemical Society vol. 134, 1987, pp. 2037 (no month).

"A New Technology of Micromachining of Silicon: Doplant Selective HF Anodic Etching for the Realization of Low–Doped Monocrystalline Silicon Structures" IEEE Electron Device Letters vol. 11, p. 588, (1990) (no month).

"An Etch–Stop Utilizing Selective Etching of N–Type Silicon by Pulsed Potential Anodization" Journal of Microelectromechanical Systems, vol. 1, 1992, p. 187, (no month).

ELECTROCHEMICAL PROCESS AND SYSTEM FOR ETCHING SEMICONDUCTOR SUBSTRATES

BACKGROUND OF THE INVENTION

1. Field of the Invention

This invention relates to improvements in a wet electrochemical etching process for a semiconductor substrate, and more particularly to such a wet electrochemical etching process for stably and effectively etching simultaneously a plurality of semiconductor substrates with a high controllability.

2. Description of the Prior Art

Hitherto a variety of electrochemical etching processes have been proposed and brought into practical use. A typical one of them is accomplished by using a wet electrochemical etching system and will be discussed hereinafter. This etching process is disclosed in "Journal of Electrochemical Society", Vol. 177, Page 959, published in 1970. The etching system includes an electrolysis vessel and a reference electrode vessel which are filled with an etching solution. The electrolysis vessel is provided therein with a semiconductor substrate to be etched, and a counter electrode. The reference electrode vessel is provided therein with a reference electrode. The electrolysis vessel and the reference electrode vessel are electrically connected with each other through a salt bridge and a Luggin capillary so as to establish ion conduction therebetween. Outside lead wires are connected at their one end with the semiconductor substrate, the counter electrode and the reference electrode. The other ends of the lead wires are connected to a potentiostat disposed outside the vessels. The semiconductor substrate is provided at its back side with a metallic electrode through which the lead wire is connected to the semiconductor substrate. The metallic electrode is formed, for example, by deposition. The etching solution in the electrolysis vessel is heated by a plate-type heater and mechanically stirred by a magnet stirrer as occasion demands. The magnetic stirrer accomplishes an etching solution stirring only in a horizontal direction.

However, drawbacks have been encountered in the above conventional etching process using the above arranged etching system. That is, the horizontal direction stirring by the magnetic stirrer cannot effectively control a flow of the etching solution to be applied to the surface (to be etched) of the semiconductor substrate, uniformly throughout the surface and with a high reproducibility, so that there is the problem of the electrochemical etching being not able to be controlled at a high controllability and a high efficiency. Additionally, in case of accomplishing an etching treatment simultaneously on a plurality of semiconductor substrates, it is very difficult to maintain the same flow condition of the etching solution applied to the respective semiconductor substrates.

This issue becomes remarkable as the surface area of the semiconductor substrate increases. For example, in production of an acceleration sensor formed of silicon semiconductor, a yield is not less than about 90% after an etching treatment in case of using a 2 inch-diameter silicon semiconductor substrate, whereas the yield is lowered to about 50% in case of using a 3 inch-diameter silicon semiconductor substrate and further lowered to about 10% in case of using a 5 inch-diameter silicon semiconductor substrate (having an etching-effective area of 4 inch diameter and having about 400 sensor elements each having dimensions of 5 mm×7 mm). An about 15% yield of the 5 inch-diameter silicon semiconductor substrate corresponds to a 90% yield of the 2 inch-diameter semiconductor substrate. Thus, not only advantages resulting from enlarging the size of the substrate cannot be exhibited, but also there is the possibility of an equipment cost and an operation cost being increased while lowering an actual yield of the product. In the conventional etching system, even if the etching system is for the etching treatment of one semiconductor substrate, there is the problem in etching solution flow controllability to be solved, so that such a problem becomes remarkable as the surface area of the semiconductor substrate increases. Accordingly, the conventional etching system is not suitable for making a simultaneous etching treatment on a plurality of the semiconductor substrates stably and at a high controllability. In this connection, it is also possible to form a flow of the etching solution on the surface of the semiconductor substrate to be etched under the effect of natural convection. However, this flow is not uniform, less in reproducibility and not suitable for wide use as compared with the above mechanical stirring by the magnetic stirrer. Therefore, with the conventional etching system, it is very difficult not only to make an electrochemical etching treatment on a large-sized semiconductor substrate but also to simultaneously make the same treatment on a plurality of the semiconductor substrates.

As a matter of course, an etching treatment efficiency is generally low if the size of each semiconductor substrate is increased while increasing the number of the semiconductor substrates which are to be simultaneously etching-treated. For example, in case of producing an acceleration sensor formed of the silicon semiconductor, it is necessary to make an electrochemical etching piercing the semiconductor substrate in a width direction. For example in case of making such piercing etching in a standard 5 inch-diameter silicon substrate having a 600 μm thickness using an etching solution of about 100% hydrazine monohydrate (at 95° C. which is the operational temperature and corresponding to an upper limit from the view point of safety) which has the highest etching speed of basic etching solutions, an operational time of about 180 minutes is to be required. In this connection, for example, the electrochemical etching speed of p-type silicon is about 2.2 μm/min. in maximum as disclosed, for example, in "Transducer 87", pages 112 to 115. Accordingly, assuming that such electrochemical etching is made to obtain several ten products per month, only etching operation requires a long total time of about several tens to several hundreds hours if the etching treatment of the semiconductor substrate is made one by one. The only etching operation is without pre- and post-treatments such as attaching and detaching operation for the semiconductor substrate, rinsing for the etched semiconductor substate, etching solution preparation and the like. Times required for the pre- and post-treatments must be increased generally in proportion to the number of the semiconductor substrates to be etching-treated. Thus, it will be appreciated that a mass-production of the acceleration sensor including mass-etching cannot be achieved if the semiconductor substrate is not enlarged in size and if the number of the semiconductor substrates to be etching-treated simultaneously is not increased.

Furthermore, about 100% hydrazine monomonohydrate as the etching solution is unstable at high temperatures and has the danger of ignition and a firing point of 74.4° C. as discussed in a technical article "Concerning Safety of Hydrazine Aqueous Solution", published on Feb. 26, 1990 from the chemical products division of Nippon Carbide Kogyo Kabushikikaisha in Japan. Accordingly, it is assumed to be desirable to lower the operation temperature for the etching solution. In this connection, it was actually measured by the inventors of the present application, that the etching treatment for a cetain semiconductor substrate required about 3 hours at the operation temperature (the temperature of the etching solution) of 195° C., about 5 hours at the operation temperature of 80° C., and about 7.5 hours at the operation temperature of 70° C. This reveals that the relatively low operation temperature largely lowers the operational or etching efficiency. Also in order to realize the high etching efficiency at the low operation temperature from the above view point, it is necessary to increase the size of the semiconductor substrate and to increase the number of the semiconductor substrates to be simultaneously etching-treated.

Additionally, difficulties in flow control has been encountered in the above conventional etching system. It will be understood that such a flow control may be able to be effectively made in a small-scale electrochemical test device which usually uses a small-size solution flowing vessel such as a beaker or the like smaller than the beaker. For example, the flow control in such a small-scale electrochemical test device is accomplished by a rotational ring disc or a channel flow measurement device for a sample having a minute size to be used in an electrochemical precise measurement, for example, as disclosed in "Newly Edited Electrochemical Measurement Method", edited by Electrochemical Association, published in 1988 by Kenyu-sha in Japan. However, there are difficulties in flow control in an electrochemical devices having a medium- or large-scale flowing vessel, for example, as disclosed in "Chemical Engineering Handbook", the chapter of "Stirring and Mixing", page 1305, published in 1978 by Maruzen in Japan. Thus, from the present engineering knowledge, it seems impossible to make an effective flow control of the etching solution in the above-mentioned conventional etching system. Moreover, assuming that a plurality of parallel flat plates are inserted in the electrolysis vessel of the above-mentioned conventional etching system so that a plurality of solution flowing regions are formed in a manner that each region is defined between the oppositely disposed flat plates, accomplishing a uniform flow control throughout all the solution flowing regions is further difficult under the horizontal stirring of the magnet stirrer. The above-discussed difficulties will cause a non-uniformity of etching on the etched surface of a semiconductor substrate and throughout a plurality of semiconductor substrates to be etched, thereby largely lowering the yield of etched products thus making impossible an effective production of the etched product such as the semiconductor acceleration sensor. It will be understood that it is very low in operational or etching efficiency to use a plurality of etching systems each of which is for one semiconductor substrate, corresponding to the number of the semiconductor substrates to be simultaneously etching-treated.

Further, during the etching of the semiconductor substrate, bubbles are vigorously formed at the etched section of the semiconductor substrate with the proceeding of an etching reaction. Such bubbling phenomena occur in almost all etching reactions regardless of kinds of etching solutions such as an electrolyte-system or a non-electrolyte system, or an acid system or a basic system and regardless of kinds of the semiconductor substrates to be etched, although different gases are generated according to the kinds of the systems. In this connection, it is to be noted that there is such possibility that the above-formed bubbles cannot be smoothly removed from the surface of the semiconductor substrate to be etched. This will lower a processing precision and a flatness of a processed surface of the semiconductor substrate, and is problematic particularly in case that a part to be etched is very fine or minute or in case that the depth of the part to be etched is large relative to the width of the same part. An etching system which is arranged taking account of the above-discussed bubbling phenomena has been proposed, for example, as disclosed in Japanese Patent Provisional Publication No. 4-157183. However, such an etching system is not suitable for simultaneously etching a plurality of semiconductor substrates and for etching a large-sized semiconductor substrate, because the cross-sectional area of the etching system will become too large while enlarging the deviation in flow speed of the etching solution between a central section and a peripheral section of the electrolysis vessel.

SUMMARY OF THE INVENTION

It is an object of the present invention is to provide an improved electrochemical etching process which can effectively overcome drawbacks encountered in conventional electrochemical etching processes.

Another object of the present invention is to provide an improved electrochemical etching process which can makes it possible to uniformly etching a semiconductor substrate throughout the surface to be exposed to an etching solution, in a high controllability and in a high operational efficiency.

A further object of the present invention is to provide an improved electrochemical etching process by which a plurality of semiconductor substrates can be simultaneously effectively etched in a high controllability and in a high operational or etching efficiency.

An aspect of the present invention resides in an electrochemical etching process comprising the following steps: (a) providing first and second walls which have respectively surfaces defining therebetween a flow region of an etching solution, the surfaces of the first and second walls facing and being spaced from each other, the surfaces of the first and second walls being generally parallel with each other; (b) mounting a semiconductor substrate and a counter electrode on the facing surfaces of the first and second wall, respectively; (c) causing the etching solution to flow through the flow region in a direction generally parallel with the facing surfaces of the first and second walls; and (d) applying an electric potential between the semiconductor substrate and the counter electrode.

Another aspect of the present invention resides in an electrochemical etching system comprising first and second walls which have respectively surfaces defining therebetween a flow region of an etching solution, the surfaces of the first and second walls facing and being spaced from each other. A semiconductor substrate is mounted on the surface of the first wall. A counter electrode is mounted on the surface of the second wall. A device is provided to cause the etching solution to flow through the flow region in a direction generally parallel with the facing surfaces of the first and second walls. Additionally, a device is provided to apply an electric potential between the semiconductor substrate and the counter electrode.

According to the present invention, a uniform etching treatment can be effectively accomplished throughout the surface of a semiconductor substrate to be etched in a high reproducibility. Additionally, a plurality of semiconductor substrates can be effectively and stably etched simultaneously in a high controllability and in a high operational or etching efficiency. As a result, microsensors such as acceleration sensors and pressure sensors, microelectronics devices, and micromechanical structures and the likes can be produced on a mass scale and in a low production cost.

BRIEF DESCRIPTION OF THE DRAWINGS

In the drawings, like reference numerals designate like elements and parts throughout all figures.

DETAILED DESCRIPTION OF THE INVENTION

Figure 1:
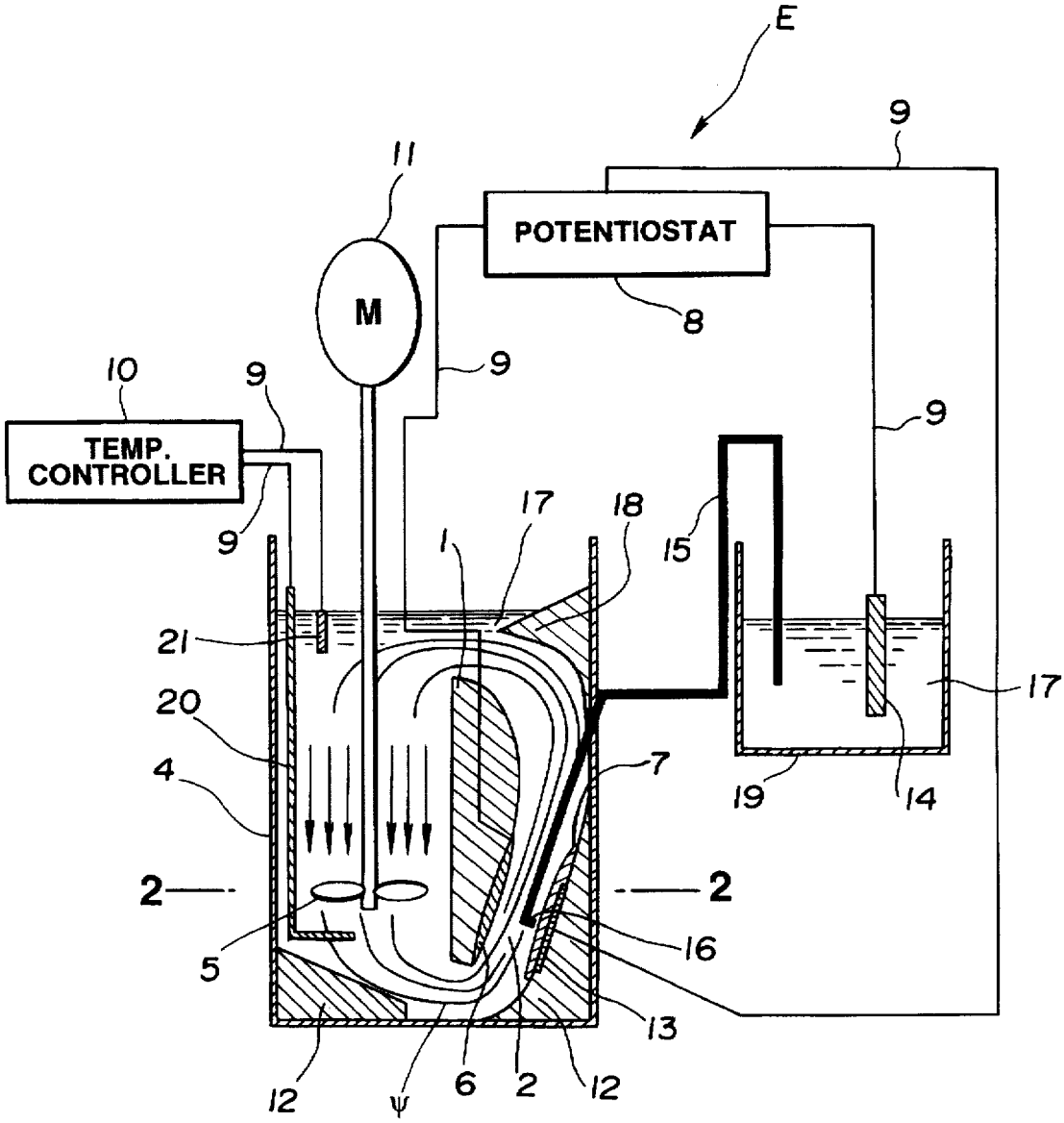
FIG. 1 is a schematic vertical sectional view of an electrochemical etching system for accomplishing a first embodiment of an electrochemical etching process according to the present invention.
Figure 2:
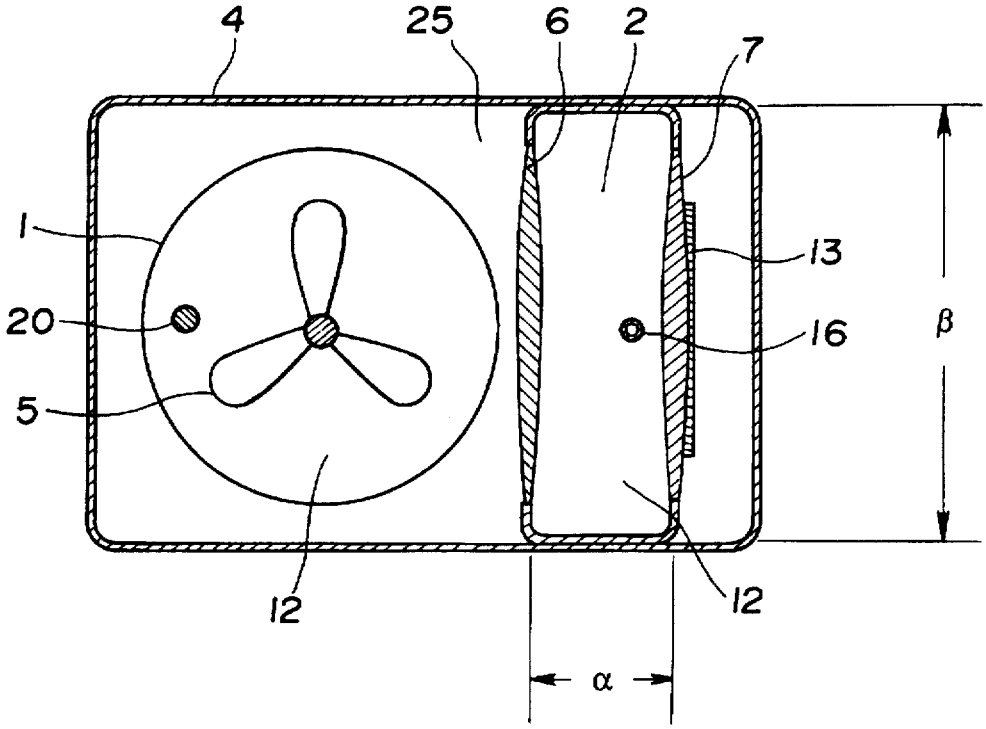
FIG. 2 is a schematic sectional view taken substantially along the line 2—2 of FIG. 1.

Referring now to FIGS. 1 and 2 of the drawings, a first embodiment of a wet electrochemical etching process for a semiconductor substrate (wafer) will be discussed. The electrochemical etching process is accomplished by an electrochemical etching system E including an electrolysis vessel 4 having a generally rectangular cross-section. An etching solution 17 is filled in the electrolysis vessel 4. A cylindrical partition wall 1 is fixedly disposed in the electrolysis vessel 4 in a manner to vertically extend. A stirring rotor 5 of the propeller type includes a plurality of blades (not identified) and is rotatably disposed inside the cylindrical partition wall 1 so as to constitute a flow stream generating section (not identified) for the etching solution 17. An electrolysis monitoring channel 2 is formed outside the cylindrical partition wall 1 and defined between inside and outside walls (not identified) which are parallel with each other and inclined relative to a vertical plane (not shown). A counter electrode 6 and a semiconductor substrate 7 are respectively disposed or mounted on the inside and outside walls of the electrolysis monitoring channel 2 so that they are parallel with each other and inclined along with the inside and outside walls of the electrolysis monitoring channel 2. A Luggin capillary 16 is set in such a manner that its tip end is located adjacent the semiconductor substrate 7.

The surface (to be electrochemically etched) of the semiconductor substrate 7 faces a fluid flow region within the electrolysis monitoring channel 2. The etching solution flows through the fluid flow region. It will be understood that jigs or the likes may slightly project from the surface of the inside and outside walls of the electrolysis monitoring channel 2 depending upon the installation states of the counter electrode 6 and the semiconductor substrate 7; however, such projecting matters never prevent the effects according to the present invention. In other words, the electrochemical etching system E of FIGS. 1 and 2 is a system for making it possible to accomplish an electrochemical etching to a semiconductor substrate or the like in a low production cost and a high yield in mass production, and therefore is not a system which is not provided with any projections for the purpose of studying a precise electrochemical mechanism using a rotary disc electrode, a channel flow electrode or the like.

The stirring rotor 5 is drivably connected to a variable rotational speed motor 11 thereby controlling a circulating flow stream of the etching solution 17. The etching solution 17 flows in a direction indicated by a symbol ψ in FIG. 1 throughout an etching solution flow path (not identified) including a vertical flow passage (not identified) defined inside the partition wall 1, a lower flow passage (not identified) defined above a bottom flow rectifying wall 12, the flow region in the electrolysis monitoring channel 2, and an upper flow passage (not identified) defined below an upper flow rectifying wall 18. As shown in FIG. 1, the upper surface of the etching solution 17 is located over the upper flow passage defined by the upper flow rectifying wall 18. The top portion of the partition wall 1 is located separate and below the upper surface of the etching solution 17 thereby to define a so-called dam (not identified) above the top portion of the partition wall 1. The central portion of the partition wall 1 is located separate from and over the bottom surface of the electrolysis vessel 4 thereby to define the lower flow passage forming part of the above-mentioned etching solution flow path.

Upon rotaton of the stirring rotor 5 in a predetermined direction under the action of the motor 11, the etching solution 17 flows circulatingly in the direction ψ from the lower side to the upper side of the vessel 4, so that the flowing etching solution 17 passes upwardly through the electrolysis monitoring channel 2 and through a space between the counter electrode 6 and the semiconductor substrate 7. It will be understood that baffles or flow rectifier plates may be suitably provided along the etching solution flow path thereby effectively changing the rotational flow of the etching solution 17 under the rotation of the stirring rotor 5 into a vertical laminar or propulsion flow so as to form a uniform upward flow of the etching solution 17, in which, for example, the baffle is provided inside the cylindrical partition wall 1.

The opposed semiconductor substrate 7 and counter electrode 6 are slightly inclined in such a manner as to be located outward in an upward and vertical direction. Additionally, the semiconductor substrate 7 is located outside of the counter electrode 6. These have been confirmed to be effective to promote release of bubbles generated during an electrochemical etching, from the semiconductor substrate 7 to be etched. For example, in case that the semiconductor substrate 7 and the counter electrode 6 are inclined by about 10 degrees in angle relative to the vertical plane upon using a hydrazine monohydrate system etching solution (in which hydrazine monohydrate is used as the etching solution), a releasing condition for the bubbles have been largely improved as compared with a case that they are vertical or not inclined.

The Luggin capillary 16 is connected through a salt bridge 15 with the etching solution 17 in a reference electrode vessel 19, so that an ionic conduction can be made between the electrolysis vessel 4 and the reference electrode vessel 19. A reference electrode 14 is dipped in the etching solution 17 in the reference electrode vessel 19. The reference electrode 14, the counter electrode 6 and the semiconductor substrate 7 are connected through outside lead wires 9 with a potentiostat 8 disposed outside the vessels 4, 19. The lead wire 9 is connected to the semiconductor substrate 7 through a metallic electrode 13 formed on the surface of the substrate 7. During the electrochemical etching, an electrochemical control is made in the monitoring channel 2 under the action of the Luggin capillary 16 in such a manner that an electric potential between the etched surface of the semiconductor substrate 7 and the counter electrode 6 is controlled at a predetermined value upon being monitored by the Luggin capillary 16 under the action of the potentiostat 8. The etching solution 17 in the vessels 4, 19 is maintained at a predetermined temperature as occasion demands by using a temperature controller 10 which is arranged to control the temperature of a heater 20 in accordance with the temperature of the etching solution 17 detected by a temperature sensor 21.

While the etching system of the so-called triple-pole type (having a working electrode or the semiconductor substrate, the reference electrode and the counter electrode) has been shown and described in the embodiment, it will be appreciated that the principle of the present invention may be applicable to another electrochemical etching system of the dual-pole type (without the reference electrode), and to a further electrochemical etching system of the triple-pole type, the dual-pole type and the quadruple-pole type using four poles in order to make a bias control to both conductivity type (n-type and p-type) regions in case of selectively etching, for example, only the p-type region or the working electrode of the semiconductor substrate, leaving the other conductivity type (n-type) region unetched.

Next, the manner of an electrochemical etching using the above etching system E will be discussed hereinafter.

In order to accomplish a stable electrochemical etching, an electrochemical control and a flow control of the etching solution 17 are preferably made as discussed, for example, in a "Electrochemical Handbook", the forth edition, the fifth chapter, published in 1985. The etching system E shown in FIGS. 1 and 2 is arranged such that the electrolysis monitoring channel 2 formed between the parallely disposed semiconductor substrate 7 and the counter electrode 6 is located outside the flow stream generating section including the cylindrical partition wall 1 and the stirring rotor 5, and therefore the etching system E is not only compact in structure but also allowed the etching solution 17 to upwardly flow through the electrolysis monitoring channel 2 under a suitable control. Accordingly, a one-direction upward flow of the etching solution 17 is formed on the etched surface of the semiconductor substrate 7, in which the linear velocity of the upward flow is easily controlled by selecting the rotational speed of the sterring rotor 5. As a result, the stable electrochemical etching can be accomplished even though there are changes in physical values as control parameters (i.e., in case that the system of the etching solution 17 and/or the etching conditions are changed), in which a slight limitation may be made depending upon the set dimension and/or shape of the etching system E. In order to effectively form the one-direction (ψ) upward flow of the etching solution 17, it is preferable that a so-called dam height or the distance between the upper surface of the etching solution 17 and the top end of the cylindrical partition wall 1 is generally equal to the diameter of a circle (not shown) having a cross-sectional area equal to that of the electrolysis monitoring channel 2. This clearly differentiates the etching system E from a conventional etching system of the so-called double vessel structure in which an etching solution in one vessel overflows into another vessel.

Figure 11:
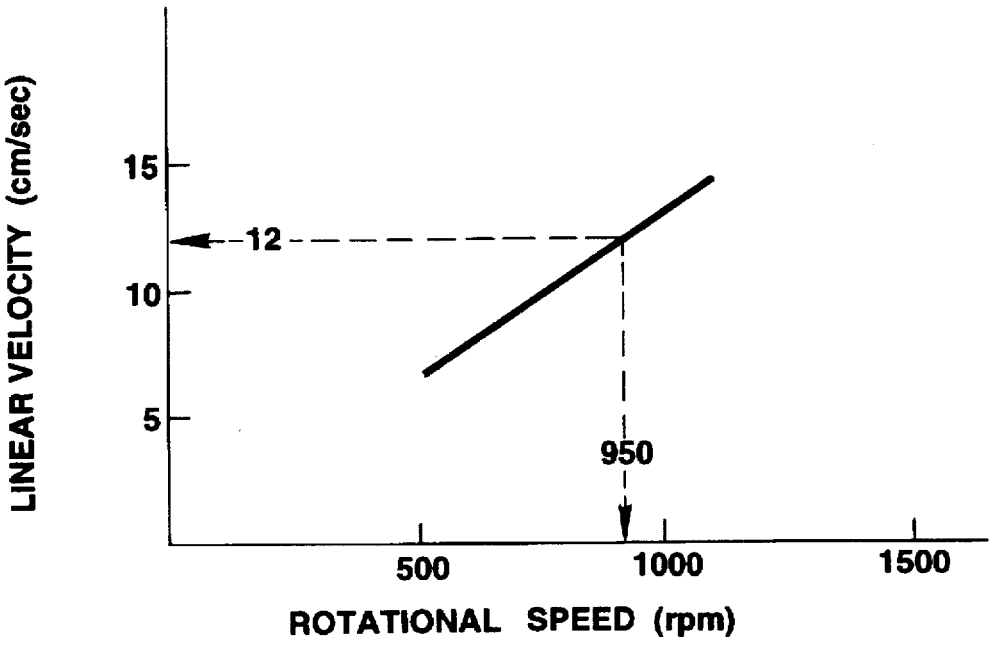
FIG. 11 is a graph showing the relationship between the rotational speed of a stirring rotor and the linear velocity of an etching solution in case of employing the etching system of FIG. 1 for an electrochemical etching using an aqueous ammonia system.

Subsequently, discusssion will be made on a case in which an aqueous ammonia system etching solution (in which aqueous ammonia is used as the etching solution) is employed in the etching system of FIGS. 1 and 2 with reference to FIGS. 11 and 12. FIG. 11 shows the relationship between the stirring rotational speed (r.p.m.) of the stirring rotor 5 and the linear velocity (in a vertical direction) of the etching solution at the central portion of the electrolysis monitoring channel 2. Here, the conditions under which the data of FIG. 11 are measured are as follows: The diameter of a circle having an area corresponding to the cross-sectional area of the monitoring channel 2 is 87.5 mm; the distance α between the electrodes 6, 7 is 40 mm; the width β of the monitoring channel 2 is 150 mm; the diameter of the propeller type stirring rotor 5 having three blades is 80 mm; the inclination angle of each blade of the stirring rotor 5 is 8 degrees in angle; and the diameter of the flow streamgenerating section or the inner diameter of the cylindrical partition wall 1 is 150 mm.

Figure 12:
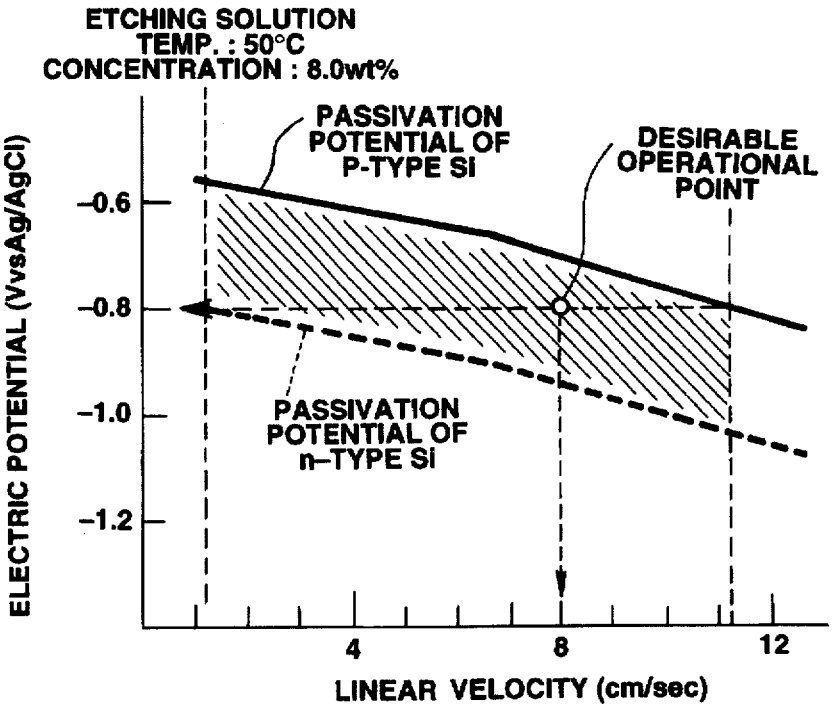
FIG. 12 is a graph showing the change in passivation potential in terms of the linear velocity of the etching solution at the central portion of an electrolysis monitoring channel.

FIG. 12 shows the relationship between the linear velocity (in a vertical direction) of the etching solution 17 at the central portion of the electrolysis monitoring channel 2 and the electric potential including an passivation potential at which the etching is stopped and an open circuit potential (natural potential) during the electrochemical etching using the aqueous ammonia system etching solution in the etching system of FIGS. 1 and 2. The data of FIG. 12 is obtained on the etching of a silicon semiconductor substrate or wafer having an effective diameter of 100 mm. FIG. 12 depicts that the flow condition of the etching solution can be treated as a controllable factor only in the etching system of the type as shown in FIGS. 1 and 2, in case that the passivation potential and the open circuit potential are remarkably affected by the linear velocity of the flowing etching solution (as in case of using the aqueous ammonia system etching solution). More specifically, for example, if it is possible to stably maintain the linear velocity of the flowing etching solution at the central portion of the monitoring channel 2 at about 8 cm/sec., it is sufficient to maintain the electric potential at −0.8 V in order to selectively etch the p-type region on the N-type semiconductor substrate. In this instance, if the stirring rotor 5 is operated at a rotational speed of about 500 to 8000 r.p.m. taking account of safety, a stable etching can be accomplished. However, a passivation film may be formed on the p-type region thereby to stop the etching in case that such a flow control changes with lapse of time and/or that the linear velocity of flowing etching solution increases over, for example, about 11 cm/sec on the surface of the semiconductor substrate to be etched, having a flow distribution in the linear velocity on the substrate surface. The passivation film formed at this time cannot be dissolved once it has been formed, even upon applying a counter bias or trying re-dissolving thereof, so that the etching at this time may come to failure or results in a very low yield. As discussed above, in a case (for example, using the aqueous ammonia system etching solution) that the etching characteristics is affected by the flowing speed of the etching solution, a suitable predetermined electrochemical etching condition can be easily selectable according to the operational manner of the present invention, in which an operation for rendering the linear velocity of the etching solution constant is made possible thereby to accomplish a selective etching for p- or n-type region.

A flow velocity distribution within the electrolysis monitoring channel 2 will be discussed on a case that the distance α between the electrodes 6, 7 is 40 mm; and the channel width β is 150 mm in FIG. 2, in which the diameter of a circle having an area corresponding to the cross-sectional area of the monitoring channel 2 is 87.5 mm. In case that the flow velocity of the etching solution at the central portion of the monitoring channel 2 becomes 8 cm/sec. upon using a 100% hydrazine monohydrate system etching solution (100% hydrazine monohydrate is used as the etching solution) at a temperature of 90° C., the Reynolds number (Re) is about 20000 so that the flow velocity is more uniformized than that in a laminar flow region. Accordingly, assuming that the radius r is $r_{max}$; and the maximum linear flow velocity is $u_{max}$ in case of a cylinder having a circular cross-section, the distribution of the linear flow velocity u in the direction of the radius r is approximated to Prandtl's 1/7 power rule as represented by an equation (P), for example, disclosed in "Chemical Engineering Handbook (the revised fifth edition)", pages 117 to 118, published by Maruzen in Japan.

$$u/u_{max}=(1-r/r_{max})^{1/7} \quad \text{(P)}$$

Figure 13:
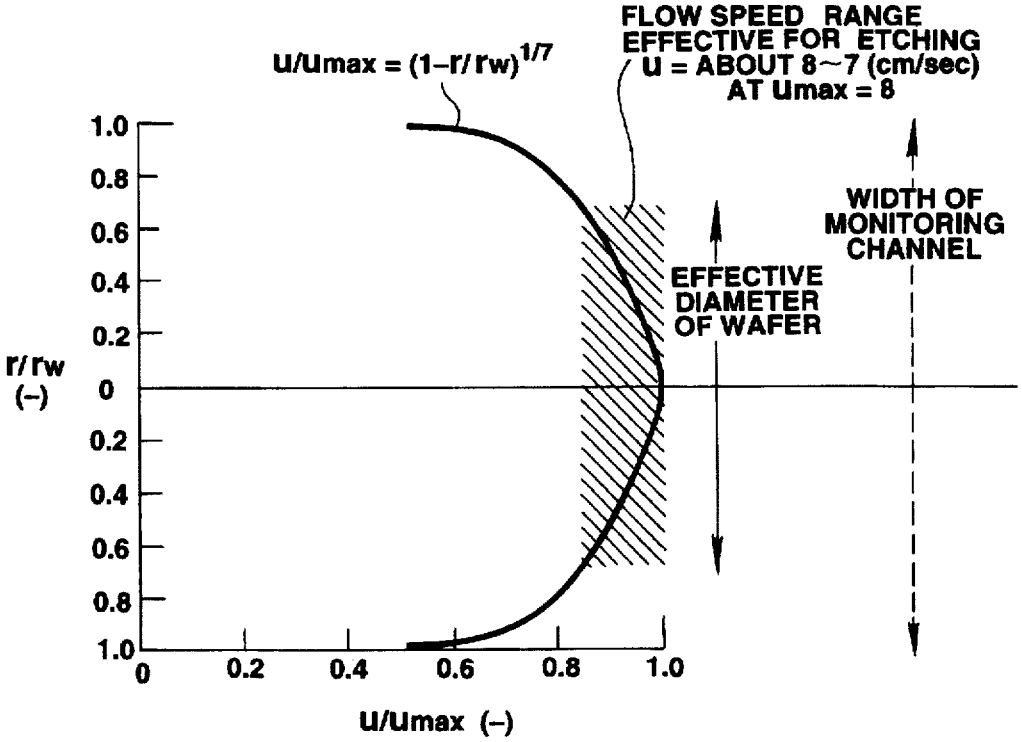
FIG. 13 is a graph showing the flow velocity distribution of an etching solution within a cylindrical channel.

The relationship of the equation (P) is represented as a graph in FIG. 13. In this case, the effective linear velocity distribution of the etching solution at the front section of the substrate or wafer 7 is about 8 to 7 cm/sec, which is considered to be within 20% of that at the central section of the substrate. As will be appreciated, the equation (P) is approximate to the cylinder and therefore must be considered to be slightly reduced when it is applied to this case using the etching system as shown in FIGS. 1 and 2. However, upon taking account of the fact that this case does not use a flow passage (having a rectangular cross-section) formed between parallel flat plates which is very small in distance therebetween, the flow velocity distribution represented by the equation (P) is considered to be sufficiently applicable to the present invention in the sense of analogy. Thus, according to the embodiment of the present invention, a one-direction flow having a less distribution in the radial direction can be realized even in case of etching a large diameter wafer or semiconductor substrate.

Figure 14B:
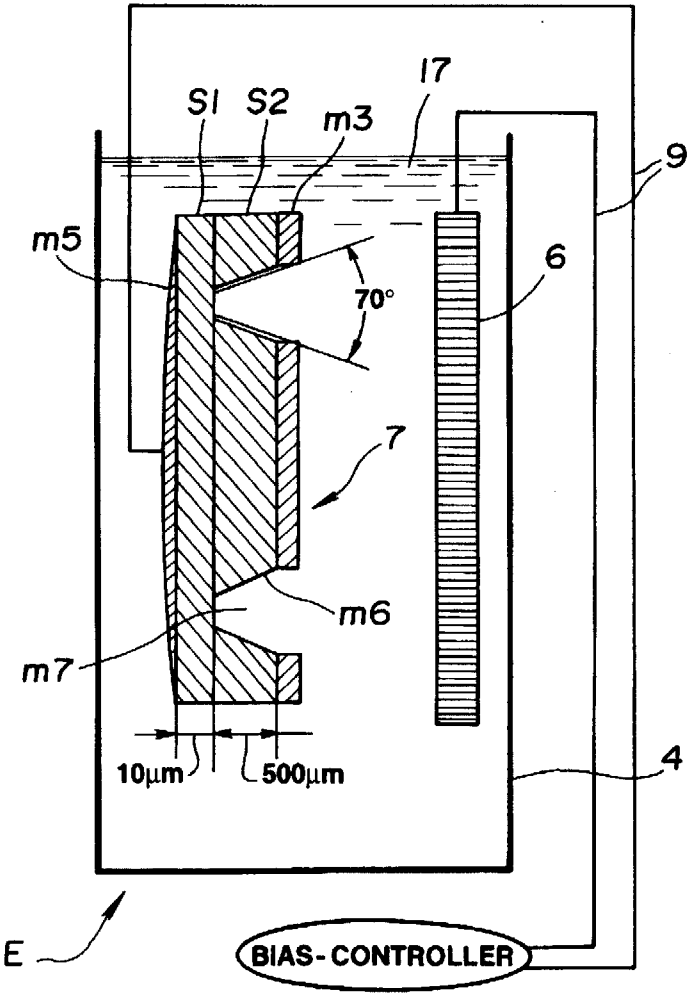
FIG. 14B is a schematic illustration of the etching system of the present invention, showing the minute structure of FIG. 14A in the form of a cross-sectional view.
Figure 14A:
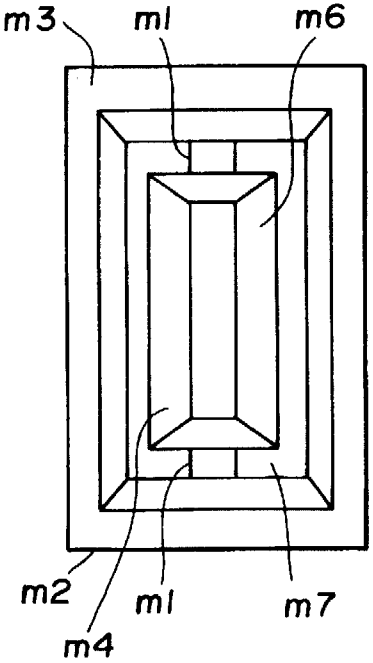
FIG. 14A is a top plan view of a minute structure (acceleration sensor) as an example of an etched semiconductor substrate, produced by the etching process of the present invention.

Such an advantageous effect has been actually confirmed on an actual example in which several hundreds of minute structures M are formed in a silicon semiconductor substrate or wafer 7 having a thickness of 450 μm and an effective diameter of 100 mm. Each minute structure M is shown in FIG. 14A and used as a semiconductor acceleration sensor. The minute structure M has two n-type beams m1 having a thickness of 10 μm. As shown in FIG. 14A, in the minute structure M, a rectangular frame m2 of a p-type semiconductor substrate beneath a mask m3 is connected through the two n-type beams ml with a weight m4, so that the weight m4 is supported by the two n-type beams m1. Production of the minute structures M upon etching is carried out in the etching system schematically illustrated in FIG. 14B in which the minute structure M includes the n-type semiconductor substrate s1 and the p-type semiconductor substrate s2. In this etching system E, the semiconductor substrate or wafer 7 including the minute structures M and the counter electrode 6 are dipped in the etching solution 17 in the etching or electrolysis vessel 4. The n-type substrate s1 is provided with a metallic electrode m5 connected to the lead wire 9. A bias control is applied through the lead wires 9 from a bias-controller to the wafer 7 and the counter electrode 6. The opposite side walls of the frame m2 and the weight m4 incline as shown in FIG. 14B to form inclined wall surfaces m6. A space indicated by m7 is formed through the p-type substrate s2 and the mask m3 by the etching. In this example, the yield of the minute structure M is over 90% in case that the specification of the thickness of the n-type beams ml is decided as 10±0.4 μm in a product. For the comparison purpose, according to a most excellent conventional example as disclosed in "IEE Trans. Electron Devices", Vol. 36, pages 663 to 669, 1989, the distribution in diaphragm thickness of not lower than ±4% was obtained in case of forming pressure sonsors in a 3-inch diameter wafer.

Additionally, the embodiment of the present invention can offer such an advantageous effect that a suitable design of the etching system according to a dimensional change of the semiconductor substrate or wafer to be etched can be easily achieved. More specifically, an etching solution flow data by the etching system of FIG. 1 having a dimension at which the data of FIG. 11 is taken can be effective for a semiconductor substrate or wafer (to be etched) having an effective diameter of not larger than about 150 mm (the channel width β is 150 mm) in case of using an etching solution system in which the flow velocity distribution on the surface of the wafer is permitted to become large. Furthermore, for example, data of the relationship between the linear velocity and the stirring rotational speed in case of increasing the width of the monitoring channel 2 can be easily predictable, so that a performance condition range of the stirring rotor 5 can be set corresponding to a predetermined linear velocity of the etching solution.

It will be understood that even in case of using a stirring rotor of a certain type other than that shown in FIGS. 1 and 2, a discharge flow amount of the etching solution from the stirring rotor is determined according to the outer diameter of the stirring rotor (blades), the etching solution system, and the etching conditions. Accordingly, if the constants and etching characteristics particular in the etching solution system have been measured by an experiment on a small-size experimental system using a small diameter substrate (wafer) other than that shown in FIG. 2, a similar etching system of the large scale suitable for etching a larger diameter substrate (wafer) can be easily designed. In other words, basic data is first taken by a small-size etching system for a small-size semiconductor substrate (wafer). More specifically, measurement is made on the relationship between the rotational speed of the stirring rotor 5 and the flow characteristic value (such as the linear velocity of the etching solution) within the electrolysis monitoring channel 2 by using the small-size experimental (etching) system which is arranged as follows: The cylindrical partition wall 1 has an inner diameter similar and slightly larger than the outer diameter of the stirring rotor (blades) 5 and is provided with the stirring rotor 5 inserted therein. The electrolysis monitoring channel 2 has dimension and shape which are set according to optimum dimension and shape corresponding to etching factors (hardly affected by the dimension of the etched substrate) such as the optimum distance value between the etched substrate and the counter electrode, the shape and dimension of the etched substrate. The cylindrical partition wall 1 and the monitoring channel 2 are connected with each other in such a manner that the cross-sectional area of a connecting section between the partition wall 1 and the monitoring channel 2 is not so smaller than that of the inside space of the partition wall 1. With such a small-size experimental system, the basic data of the relationship between the factors such as the etching solution flow characteristics and the etching characteristics are measured, thereby determining the etching solution flow conditions for realizing a desired etching. Then, it is sufficient that designing is made to realize the flow conditions in a large-size (etching) system in accordance with the determined etching solution flow condition.

Effects of the size or dimension of the etching system on flow conditions of the etching solution will be discussed on an actual example using the etching system employed for measurement of the data of FIG. 11. It is known that the discharge amount q of a stirring vessel or cylindrical partition wall 1 provided with the propeller type stirring rotor 5 having three blades and dimensions (the pitch=the length of the blade; 0.2<the length of the blade/the diameter of the stirring vessel<0.33; and outer diameter of the stirring rotor (blades)=the installation height of the blades) is quantified by an equation (1) as disclosed, for example, in "Chemical Engineering Handbook (revised fifth edition)", pages 893 to 895, particularly Table 20.2, published by Maruzen in 1988 in Japan:

$$q=a\cdot n\cdot d^{3}(d/D)^{B} \quad (1)$$

where A and B are the characteristic constants, respectively; n is the rotational speed of the stirring rotor; d is the outer diameter of the stirring rotor (blades); D is the diameter of the stirring vessel. As appreciated from the above, if the outer diameter of the stirring rotor blades and the stirring vessel diameter are set, the discharge amount q of the stirring rotor is determined in accordance with the stirring rotor rotational speed in an etching solution system. Additionally, it will be understood from the above equation (1), that if the ratio (d/D) between the outer diameter of the stirring rotor and the diameter of the stirring vessel is constant and the rotation speed of the stirring rotor is constant, the discharge amount q is proportional to about the cube of the outer diameter of the stirring rotor (blades).

For example, a process as set forth below is conducted in order to design a large-size etching system b suitable for a 8 inch-diameter semiconductor substrate, similar to a small-size etching system a suitable for a 5 inch-diameter semiconductor substrate by using the data taken by the small-size etching system a (having the outer diameter $d_a$ of the stirring rotor of 8 cm) which is one by which the data of FIG. 11 is taken. That is, assume that it is confirmed that a desirable etching operation is made under the linear velocity of the etching solution of 12 cm/sec (at the stirring rotor rotational speed of 950 r.p.m) in the aqueous ammonia system etching solution (1.2 wt %) at 70° C. under the data of the etching system a. In order to realize the same desirable etching operation in the etching system b, on the assumption that the outer diameter $d_b$ of the stirring rotor (blades) is 10 cm, the following relationship is established:

$$(d_b/d_a)^3=2$$

Therefore, it is lead from FIG. 11 that the following rotational speed of the stirring rotor 5 of the etching system b is used as an aim:

950/2=480 r.p.m.

Thus, etching of the 8 inch-diameter semiconductor substrate is made possible by installing the stirring rotor 5 whose controlled rotational speeds are within a low speed region, in the etching system b which is similar to the etching system a and formed by enlarging the etching system a in a three-dimensional manner so as to enlarge the outer diameter of the stirring rotor (blades) 5 to 10 cm.

Similarly, design of an etching system for simultaneously etching many semiconductor substrates can be achieved. That is, if the optimum etching solution flow condition is obtained for the etching system having one electrolysis monitoring channel 2, it is sufficient that the diameter of a cylindrical flow path (formed inside the partition wall 1) and the outer diameter of the stirring rotor (blades) 5 are enlarged in order to generate a necessary flow stream of the etching solution within the cylindrical flow path in accordance with the number of the monitoring channels 2 to be increased. In other words, the above-mentioned equation (1) can be applied in case that the diameter of the cylindrical flow path, the outer diameter and the shape of the stirring rotor blades are kept the same as those in the etching system for etching a single semiconductor substrate, in which the following relationships are established:

$$q_m=A\cdot n_m\cdot(d_m)^3(\text{a constant value})^B \quad (1')$$

$$q_1=A\cdot n_1\cdot(d_1)^3(\text{a constant value})^B \quad (1'')$$

on the assumption that the discharge flow amount and the outer diameter of the stirring rotor (blades) of the etching system having m (plural number) monitoring channels 2 are respectively $q_m$ and $d_m$; and the corresponding amount and outer diameter of the etching system having a single monitoring channel 2 are respectively $q_1$ and $d_1$.

Now, assuming that $n_m=n_1$, the following relationships are established:

$$q_m/q_1=m=(d_m/d_1)^3 \quad (2)$$

therefore, $$d_m=d_1\sqrt[3]{(\log m)} \quad (3)$$

Thus, the outer diameter $d_m$ of the stirring rotor (blades) to be increased can be easily obtained thereby achieving the design of the etching system for etching many semiconductor substrates simultaneously. It will be understood that if the obtained dm seems to be too large, the discharge flow amount of the etching solution of the stirring rotor may be regulated by controlling the rotational speed of the stirring rotor 5.

Figure 4:
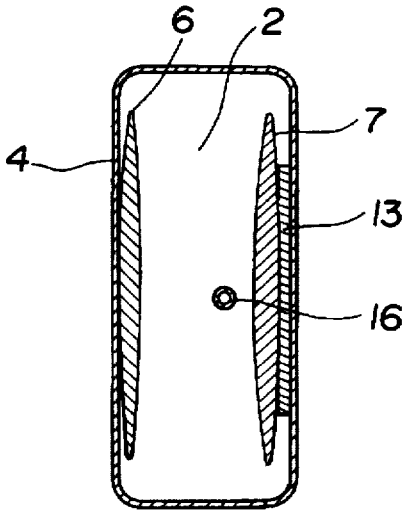
FIG. 4 is a schematic sectional view taken substantially along the line 4—4 of FIG. 3.
Figure 3:
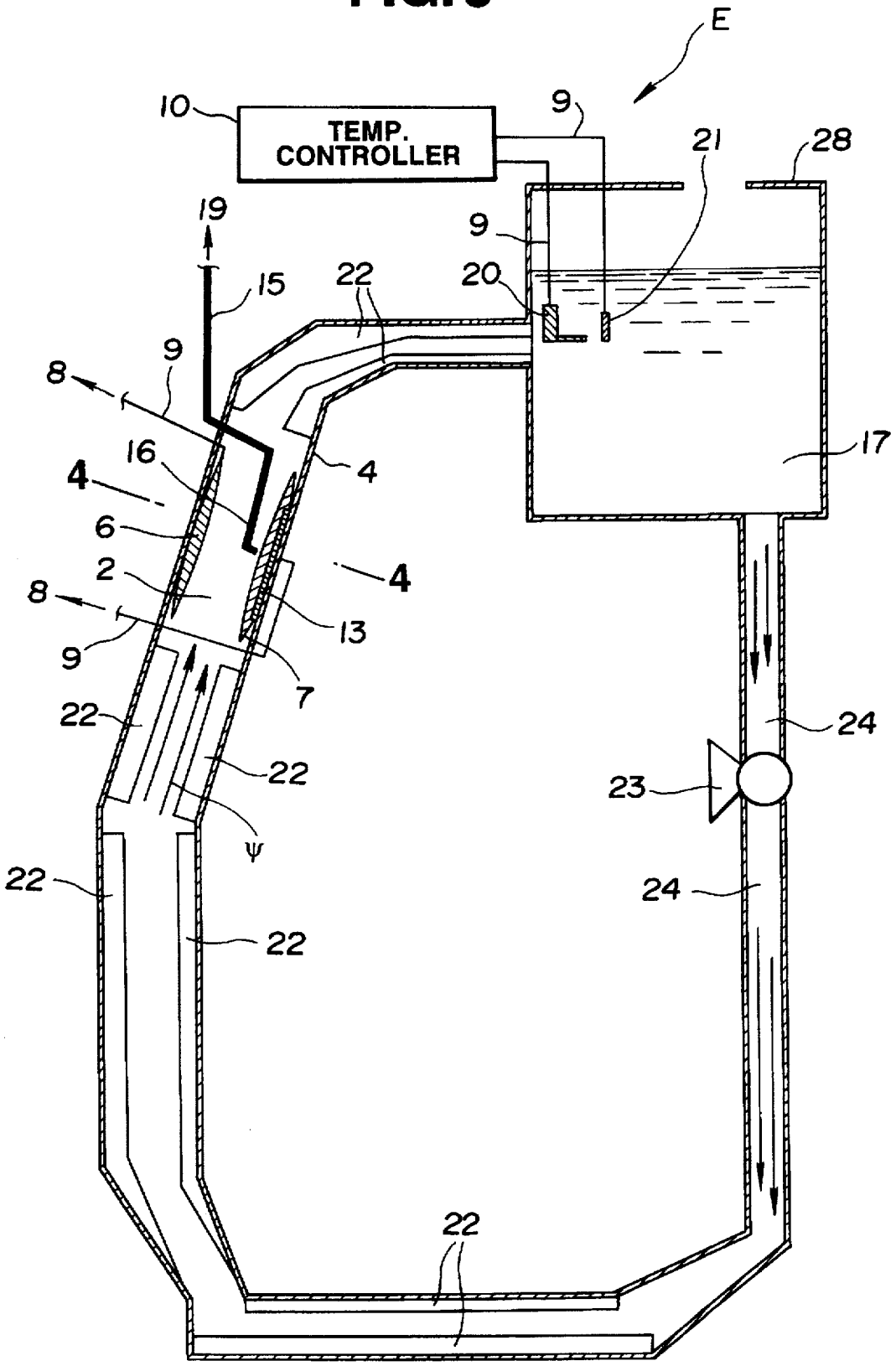
FIG. 3 is a schematic vertical sectional view of an 35 electrochemical etching system for accomplishing a second embodiment of the electrochemical etching process according to the present invention.

FIGS. 3 and 4 illustrate a second embodiment of the electrochemical etching process according to the present invention, similar to that of the first embodiment of FIGS. 1 and 2. First, the electrochemical etching system E used for the etching process will be discussed. The electrolysis monitoring channel 2 is formed in the electrolysis vessel 4 of the conduit type and located between the opposite side walls in the electrolysis vessel 4. One of the side walls is provided with the semiconductor substrate 7 adjacent which the Ruggin capillary 16 is positioned. The counter electrode 6 is securely disposed on the other side wall. The semiconductor substrate 7 and the counter electrode 6 are disposed parallel with the corresponding side walls and parallel with each other in such a manner as to incline relative to the vertical plane (not shown). As a matter of course, the surface of the semiconductor substrate 7 to be etched faces the flow path (or the flow region) of the etching solution 17 in the monitoring channel 2.

The flow stream of the etching solution 17 is generated by a pump 23 for circulating the etching solution 17. The pump 23 is operated to obtain a predetermined discharge flow amount and disposed in a circulation conduit 24 which is connected to the monitoring channel 2 to constitute the etching solution flow path (not identified). The etching solution flows in the direction indicated by the symbol ψ in FIG. 3, so that the etching solution 17 upwardly flows to pass through the space between the semiconductor substrate 7 and the counter electrode 6. It will be understood that the upward flow through the monitoring channel 2 is preferably made within a laminar flow region. Additionally, baffles (flow rectifying plates) 22 are preferably formed within the etching solution flow path to vertically rectify the flow of the etching solution 17.

An etching solution tank 28 is provided in the etching solution flow path so as to be connected to the electrolysis vessel 4 and to the circulation conduit 24. The heater 20 and the temperature sensor 21 are dipped in the etching solution 17 within the tank 28, so that the etching solution can be maintained at a predetermined temperature. The tank 28 not only functions to control the temperature of the etching solution but also serves as a gas trap for preventing an excess amount of nitrogen gas from being unnecessarily circulated, the nitrogen gas being mixed in the etching solution 17 for the purpose of making replacement between gas bubbling during etching and dissolved oxygen in the etching solution so as to obtain an electrochemical stable state.

Here, the opposed semiconductor substrate 7 and the counter electrode 6 are slightly inclined in such a manner as to be located gradually outward in the upwardly vertical direction as shown in FIG. 3. This has been confirmed to be effective to promote release of bubbles generated during an electrochemical etching, from the surface of the semiconductor substrate 7 to be etched. For example, in case that the semiconductor substrate 7 and the counter electrode 6 are inclined by about 10 degrees in angle relative to the vertical plane upon using hydrazine monohydrate system etching solution, a releasing condition for the bubbles have been largely improved as compared with a case that they are vertical or not inclined.

It will be understood that in order to make the etching system E further small-sized, the plurality of semiconductor substrates 7 are located to be generally vertically aligned along the inclined side walls of the monitoring channel 2, in which a plurality of the corresponding counter electrodes 6 are also similarly located.

with the above etching system E, the electrochemical control in the monitoring channel 2 is carried out generally in the same manner as that in the first embodiment shown in FIGS. 1 and 2. In other words, during the electrochemical etching, an electrochemical control is made in the monitoring channel 2 under the action of the Luggin capillary 16 in such a manner that an electric potential between the etched surface of the semiconductor substrate 7 and the counter electrode 6 is controlled at a predetermined value upon being monitored by the Luggin capillary 16 under the action of the potentiostat 8. It will be appreciated that it is possible to largely increase the amount of the etching solution to be circulated by enlarging the etching solution tank 28. This makes it possible to accomplish the etching treatment for a large number of semiconductor substrates 7 upon a one-time charging of the etching solution 17 while suppressing the fatigue or deterioration of the etching solution in one etching process, thus achieving a stable etching treatment even with lapse of time.

As appreciated from the above, the etching systems shown in FIGS. 1, 2, 3 and 4 not only make it possible to accomplish a stable etching under a precise control but also makes it possible to be smoothly compatible with a size-increasing of semiconductor substrates to be etched.

Figure 5:
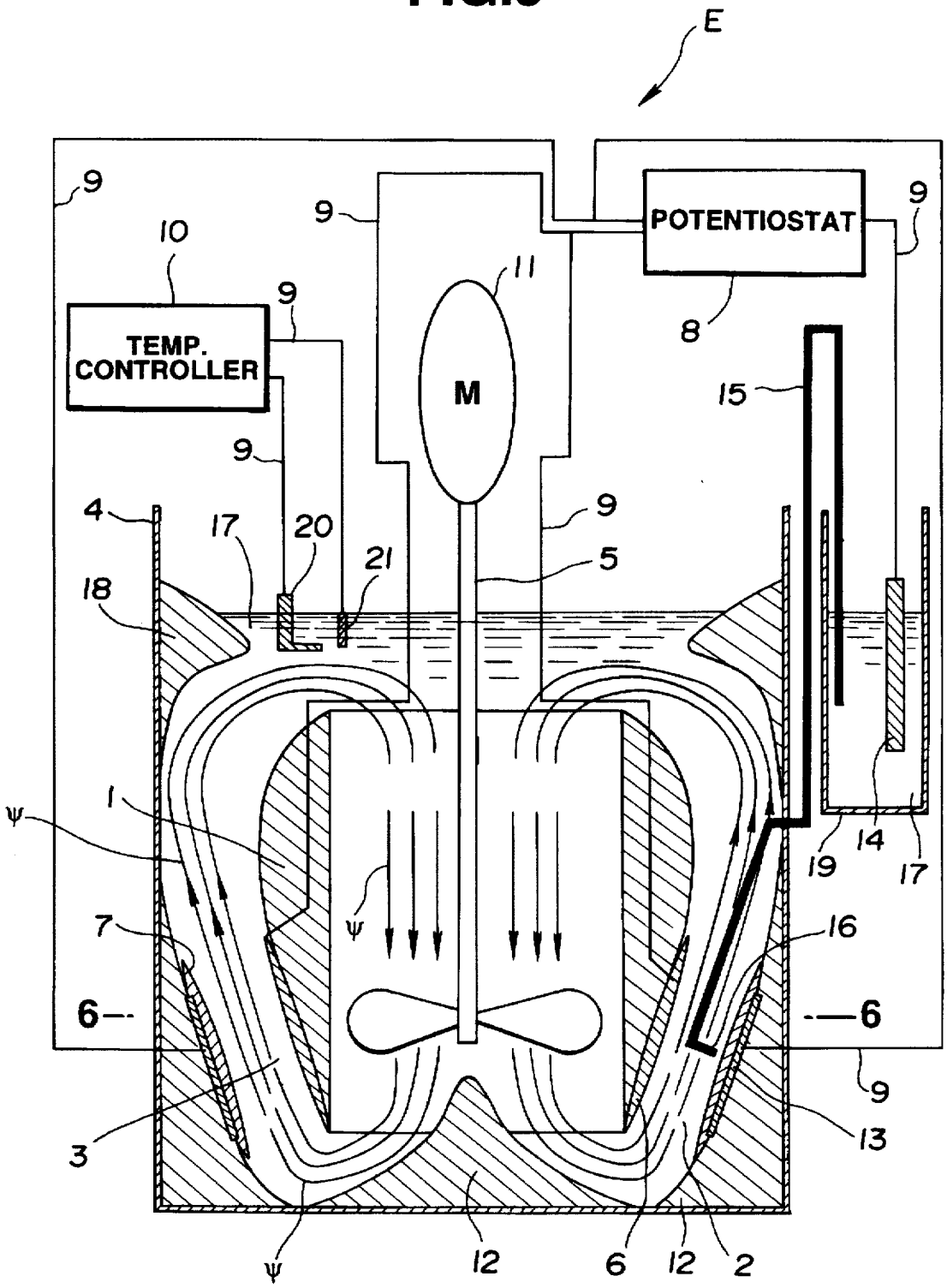
FIG. 5 is a schematic vertical sectional view of an electrochemical etching system for accomplishing a third embodiment of the electrochemical etching process according to the present invention.
Figure 6:
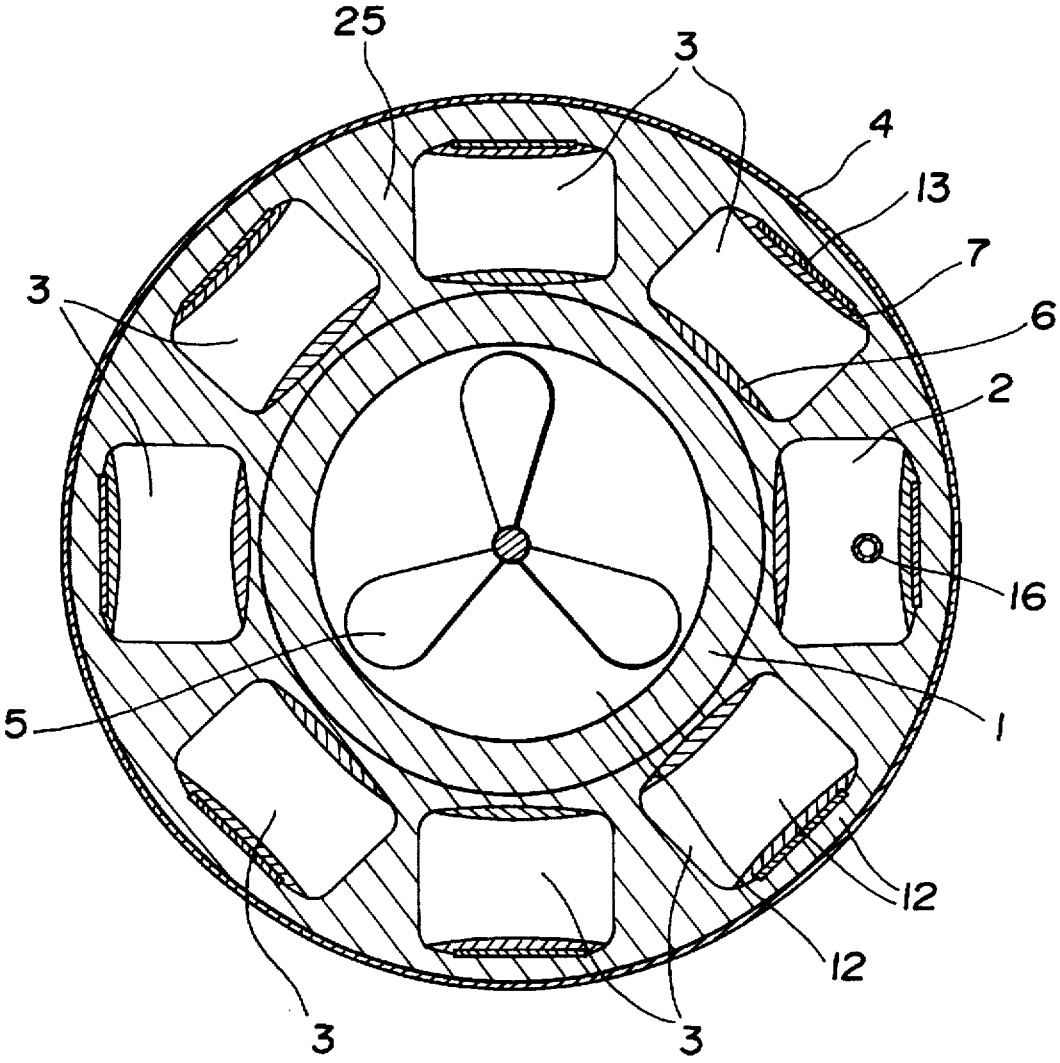
FIG. 6 is a schematic sectional view taken substantially along the line 6—6 of FIG. 5.

FIGS. 5 and 6 illustrate a third embodiment of the electrochemical etching process according to the present invention, similar to that of FIGS. 1 and 2. In this embodiment, the etching process is accomplished by the electrochemical etching system E which includes the cylindrical partition wall 1 which is fixedly disposed in the electrolysis vessel 4. One electrolysis monitoring channel 2 and seven electrolysis channels 3 are formed radially outside of the partition wall 1 and located circularly along the outer periphery of the cylindrical partition wall 1 at equal intervals as clearly shown in FIG. 6. With this etching system E, eight semiconductor substrates or wafers can be simultaneously subjected to etching treatment. The respective channels 2, 3 have the same dimension and are in the same locational relationship relative to the flow stream generating section defined inside the cylindrical partition wall 1. Each channel 2, 3 is defined between inside and outside side walls (not identified) which are inclined relative to the vertical plane (not shown) in a manner to be located outward in the upward vertical direction. The semiconductor substrate 7 and the counter electrode 6 are securely disposed on the inside and outside side walls of each channel 2, 3 in such a manner to be parallel with each other. The semiconductor substrate 7 and the counter electrode 6 are located to have the same inclination relative to the vertical plane. As a matter of fact, the etched surface of the semiconductor substrate 7 faces the etching solution flow path formed in the channel 2, 3. Although totally eight channels 2, 3 have been shown and described as being formed in this instance, it will be understood that the number of the channels 2, 3 may be two or more, in which the channels 2, 3 are arranged symmetrical of the axis of the cylindrical partition wall 1.

Flow stream of the etching solution 17 is generated by the stirring rotor 5 which is driven by the motor 11 whose rotational speed is controllable. The etching solution 17 flows in the direction indicated by the symbol ψ through the etching solution flow path which is defined by the cylindrical partition wall 1, the flow rectifying wall 18 and the flow rectifying bottom wall 12. The stirring rotor 5 of this instance is of the propeller type and functions to generate the flow stream of the etching solution 17 in the direction of from lower side to upper side in each channel 2, 3 upon being rotated in a predetermined direction by the motor 5. Accordingly, the etching solution 17 flows upwardly through the space between the semiconductor substrate 7 and the counter electrode 6, in which the upward flow of the etching solution is preferably made within a laminar flow region. It is preferable from a view point of flow control, that the total cross-sectional area of all the channels 2, 3 are generally equal to the total cross-sectional area of the remaining part of electrolysis vessel 4 in a horizontal plane (not shown). Baffles or flow rectifying plates may be effective for rectifying vertically flow of the etching solution 17 to obtain uniform upward flow of the etching solution 17 and may be provided, for example, inside the cylindrical partition wall 1.

While the outer surface of the cylindrical partition wall 1 and the inner wall surface of the inner flow rectifying walls 12, 18 of the electrolysis vessel 4 have been shown and described as being formed in a streamline shape in this instance, it will be appreciated that they are not limited to be formed in such a shape and therefore may be formed into other shapes, in which they may be formed into the simplest vertical extending cylindrical shape. It is to be noted that the opposed semiconductor substrate 7 and the counter electrode 6 are slightly inclined in such a manner as to be located gradually outward in the upwardly vertical direction as shown in FIG. 5. This has been confirmed to be effective to promote release of bubbles generated during an electrochemical etching, from the surface of the semiconductor substrate 7 to be etched. For example, in case that the semiconductor substrate 7 and the counter electrode 6 are inclined by about 10 degrees in angle relative to the vertical plane upon using a hydrazine monohydrate system etching solution, a releasing condition for the bubbles have been largely improved as compared with a case that they are vertical or not inclined.

It will be understood that the etching system E can be made further small-sized by generally vertically aligning the plurality of semiconductor substrates 7 along the inclined side walls of the monitoring channel 2, in which a plurality of the corresponding counter electrodes 6 are also similarly located. Although the respective channels 2, 3 have been shown and described as being separate from each other by means of walls such as the rectifying bottom wall 12 and the rectifying upper wall 18, it will be appreciated that the respective channels 2, 3 may be fluidly connected with each other, or a circular (in cross-section) channel is formed between the inner wall of the electrolysis vessel 4 and the cylindrical partition wall 1 so that a plurality of pairs of the semiconductor substrate 7 and the counter electrode 6 are disposed or set in the circular channel. In this case, a baffle or flow rectifying plate may be disposed between the adjacent two pairs of the semiconductor substrate 7 and the counter electrode 6 in a manner to extend in the direction of a normal line relative to the inner surface of the electrolysis vessel 4. This will form a stable upward flow of the etching solution 17.

With the above etching system E, the electrochemical control in the monitoring channel 2 is carried out generally in the same manner as that in the first embodiment shown in FIGS. 1 and 2. In other words, during the electrochemical etching, an electrochemical control is made in the monitoring channel 2 under the action of the Luggin capillary 16 in such a manner that an electric potential between the etched surface of the semiconductor substrate 7 and the counter electrode 6 is controlled at a predetermined value upon being monitored by the Luggin capillary 16 under the action of the potentiostat 8. The electric potential control made between the semiconductor substrate 7 and the counter electrode 6 in the monitoring channel 2 is also carried out in the remaining all channels 3 under the action of the potentiostat 8, thereby accomplishing the same etching on all the semiconductor substrates 7. The condition of the etching is determined by an electric potential control and a flow control of the etching solution in the case of an etching operation or process made for a plurality of the semiconductor substrates 7 having the same structure and the same dimension upon using the same etching solution. It will be understood that, in this instance, the respective channels 2, 3 are the same in flow condition of the etching solution, and therefore the same etching state as in the semiconductor substrate in the monitoring channel 2 can be accomplished in all the other semiconductor substrates in the electrolysis channels 3 by applying the same electric potential control as in the monitoring channel 2 to the electrolysis channels 3. It is to be noted that the etching in such a manner can be achieved with only a single Luggin capillary 16, and therefore the etching system of this instance is simple in construction and low in production cost. Because, installation of a Luggin capillary 16 provides many technical difficulties, in which many know-knows are required for designing and producing a Luggin capillary.

Concerning designing and producing a Luggin capillary, there is a tentative guide line as disclosed in "Newly Edited Electrochemical Measurement Method", edited by Electrochemical Association, published in 1988 by Kenyu-sha in Japan, pages 58 to 59. However, the Ruggin capillary includes a thin capillary which must be produced by processing a fine insulating material such as glass, and therefore it is difficult to produce a Luggin capillary precisely in conformity with the specification in the design drawing, and it is very difficult also for a skilled artisan to reproduce Luggin capillaries having the same dimension and shape. Additionally, it is also difficult to locate the Luggin capillary at a position separate from the surface of the semiconductor substrate by a predetermined distance and to set the tip end face to have the same inclination as that of the semiconductor substrate 7. Furthermore, in case of using a plurality of Ruggin capillarys, it is very difficult to install the Ruggin capillaries at suitable positions, taking accounting of the different dimensions and shapes of the respective Luggin capillaries. Thus, using plural Luggin capillaries not only contributes to increasing production cost of the etching system but also provides the possibility of etching controllability being lowered. Consequently, it is advantageous to use a single Luggin capillary in each etching system though a good Luggin capillary must be carefully installed in position.

Also in this instance, the etching solution 17 in the vessels 4, 19 are maintained at a predetermined temperature as occasion demands by using the temperature controller 10 which is arranged to control the temperature of the heater 20 in accordance with the temperature of the etching solution 17 detected by the temperature sensor 21.

Figure 7:
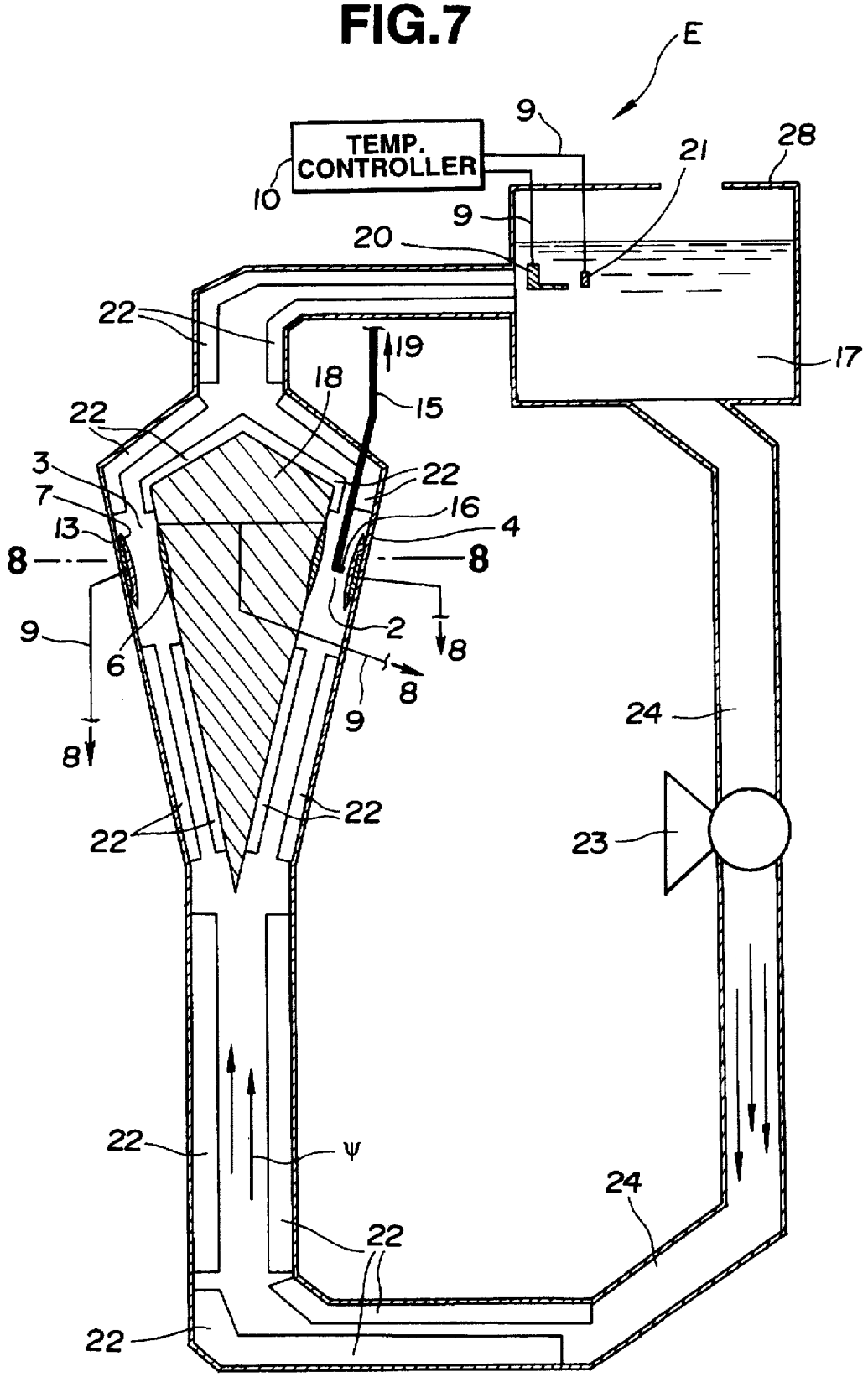
FIG. 7 is a schematic vertical sectional view of an electrochemical etching system for accomplishing a fourth embodiment of the electrochemical etching process according to the present invention.
Figure 8:
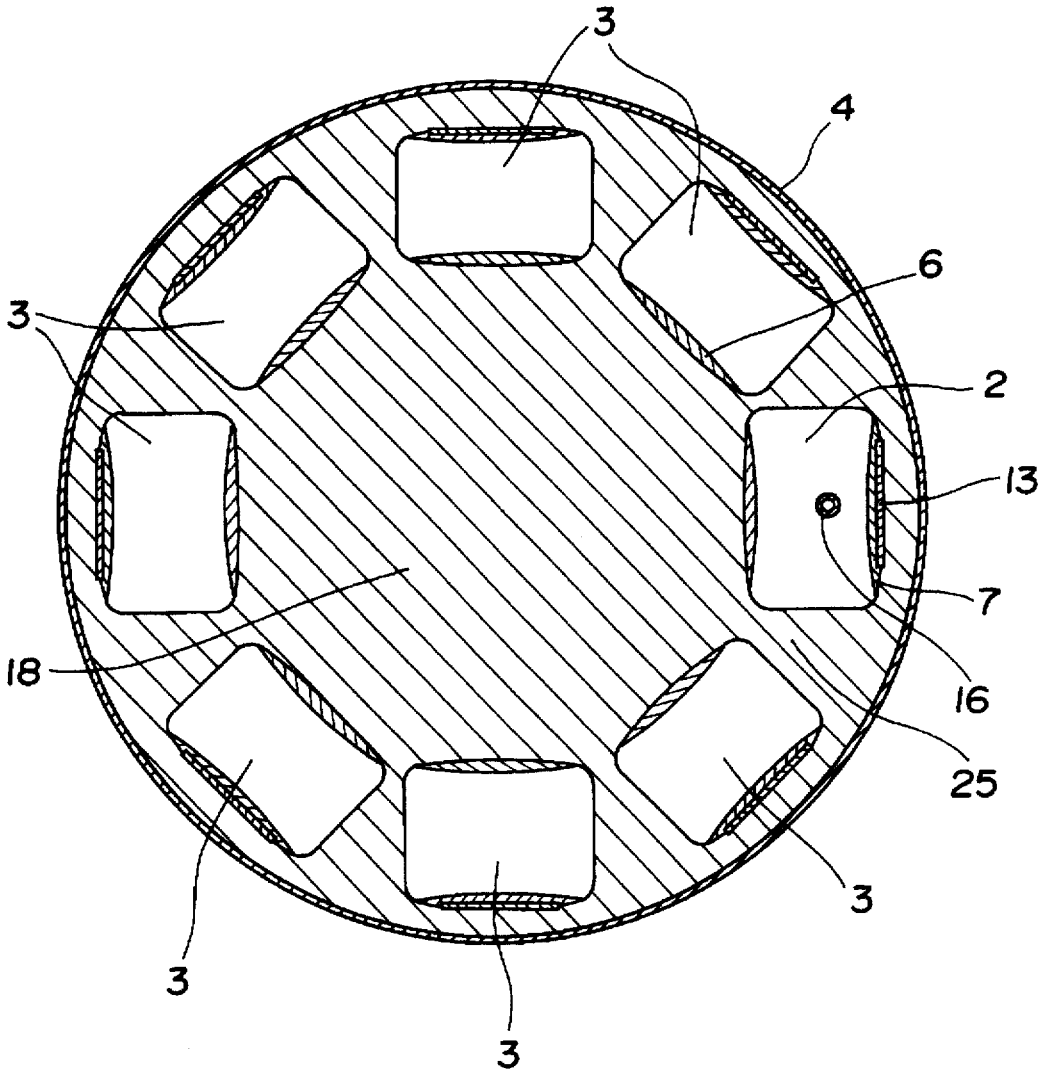
FIG. 8 is a schematic sectional view taken substantially along the line 8—8 of FIG. 7.

FIGS. 7 and 8 illustrate a fourth embodiment of the electrochemical etching process according to the present invention, which is similar to that of the second embodiment of FIGS. 3 and 4. In this embodiment, the etching process is accomplished by the electrochemical etching system E which includes the conduit type electrolysis vessel 4 disposed in the etching solution circulation conduit 24. The flow rectifying wall 18 is disposed inside the electrolysis vessel 4 and located in such a manner that one electrolysis monitoring channel 2 and seven electrolysis channels 3 are formed in the electrolysis vessel 4. The channels 2, 3 are located circularly along the inner periphery of the inner peripheral surface of the electrolysis vessel 4 at equal intervals as clearly shown in FIG. 8. With this etching system E, eight semiconductor substrates or wafers 7 can be simultaneously subjected to the etching treatment. The respective channels 2, 3 have the same dimension and are in the same locational relationship relative to the axis of the electrolysis vessel 4. Each channel 2, 3 is inclined relative to the vertical plane (not shown) in a manner to be located outward in the upward vertical direction. The semiconductor substrate 7 and the counter electrode 6 are securely disposed on the inside and outside side walls of each channel 2, 3 in such a manner to be parallel with each other. The semiconductor substrate 7 and the counter electrode 6 are located to have the same inclination relative to the vertical plane. As a matter of fact, the etched surface of the semiconductor substrate 7 faces the etching solution flow path formed in the channel 2, 3. Although totally eight channels 2, 3 have been shown and described as being formed in this instance, it will be understood that the number of the channels 2, 3 may be two or more, in which the channels 2, 3 are arranged symmetrical of the axis of the electrolysis vessel 4.

The flow stream of the etching solution 17 is generated by the pump 23 for circulating the etching solution 17. The pump 23 is operated to obtain a predetermined discharge flow amount, and disposed in the circulation conduit 24 which is connected to the monitoring channel 2 to constitute the etching solution flow path (not identified). The etching solution flows in the direction indicated by the symbol $\psi$ in FIG. 3, so that the etching solution 17 upwardly flows to pass through the space between the semiconductor substrate 7 and the counter electrode 6. It will be understood that the upward flow through the monitoring channel 2 is preferably made within a laminar flow region. Additionally, baffles (flow rectifying plates) 22 are preferably formed within the etching solution flow path to vertically rectify the flow of the etching solution 17 to obtain a uniform upward flow of the etching solution 17.

The etching solution tank 28 is provided in the etching solution flow path so as to be connected to the electrolysis vessel 4 and to the circulation conduit 24. The heater 20 and the temperature sensor 21 are dipped in the etching solution 17 within the tank 28, so that the etching solution can be maintained at a predetermined temperature. The tank 28 not only functions to control the temperature of the etching solution but also serves as a gas trap for preventing an excess amount of nitrogen gas from being unnecessarily circulated, the nitrogen gas being mixed in the etching solution 17 for the purpose of making replacement between gas bubbling during etching and dissolved oxygen in the etching solution so as to obtain an electrochemical stable state.

The opposed semiconductor substrate 7 and counter electrode 6 are slightly inclined in such a manner as to be located gradually outward in the upwardly vertical direction as shown in FIG. 7. This has been confirmed to be effective to promote release of bubbles generated during an electrochemical etching, from the surface of the semiconductor substrate 7 to be etched. For example, in case that the semiconductor substrate 7 and the counter electrode 6 are inclined by about 10 degrees in angle relative to the vertical plane upon using hydrazine monohydrate system etching solution, a releasing condition for the bubbles have been largely improved as compared with a case that they are vertical or not inclined. It will be understood that in order to make the etching system E further small-sized, the plurality of semiconductor substrates 7 are located to be generally vertically aligned along the inclined side wall of the monitoring channel 2, in which a plurality of the corresponding counter electrodes 6 are also similarly located.

Although the respective channels 2, 3 have been shown and described as being separate from each other by means of walls such as the rectifying bottom walls 1 and the rectifying wall 18, it will be appreciated that the respective channels 2, 3 may be fluidly connected with each other, or a circular (in cross-section) channel is formed inside the inner wall of the electrolysis vessel 4 so that a plurality of pairs of the semiconductor substrate 7 and the counter electrode 6 are disposed or set in the circular channel. In this case, a flow rectifying plate may be disposed between the adjacent two pairs of the semiconductor substrate 7 and the counter electrode 6 in a manner to extend in the direction of a normal line relative to the inner surface of the electrolysis vessel 4. This will form a stable upward flow of the etching solution 17.

With the above etching system E, the electrochemical control in the monitoring channel 2 is carried out generally in the same manner as that in the first embodiment shown in FIGS. 1 and 2. In other words, during the electrochemical etching, an electrochemical control is made in the monitoring channel 2 under the action of the Luggin capillary 16 in such a manner that an electric potential between the etched surface of the semiconductor substrate 7 and the counter electrode 6 is controlled at a predetermined value upon being monitored by the Luggin capillary 16 under the action of the potentiostat 8. The electric potential control made between the semiconductor substrate 7 and the counter electrode 6 in the monitor channel 2 is also carried out in the remaining all channels 3 under the action of the potentiostat 8, thereby accomplishing the same etching on all the semiconductor substrates 7. The condition of the etching is determined by an electric potential control and a flow control of the etching solution in the case of an etching operation or process made for a plurality of the semiconductor substrates 7 having the same structure and the same dimension upon using the same etching solution. It will be understood that, in this instance, the respective channels 2, 3 are the same in flow condition of the etching solution, and therefore the same etching state as in the semiconductor substrate in the monitoring channel 2 can be accomplished in all the other semiconductor substrates in the electrolysis channels 3 by applying the same electric potential control as in the monitoring channel 2 to the electrolysis channels 3.

Figure 9:
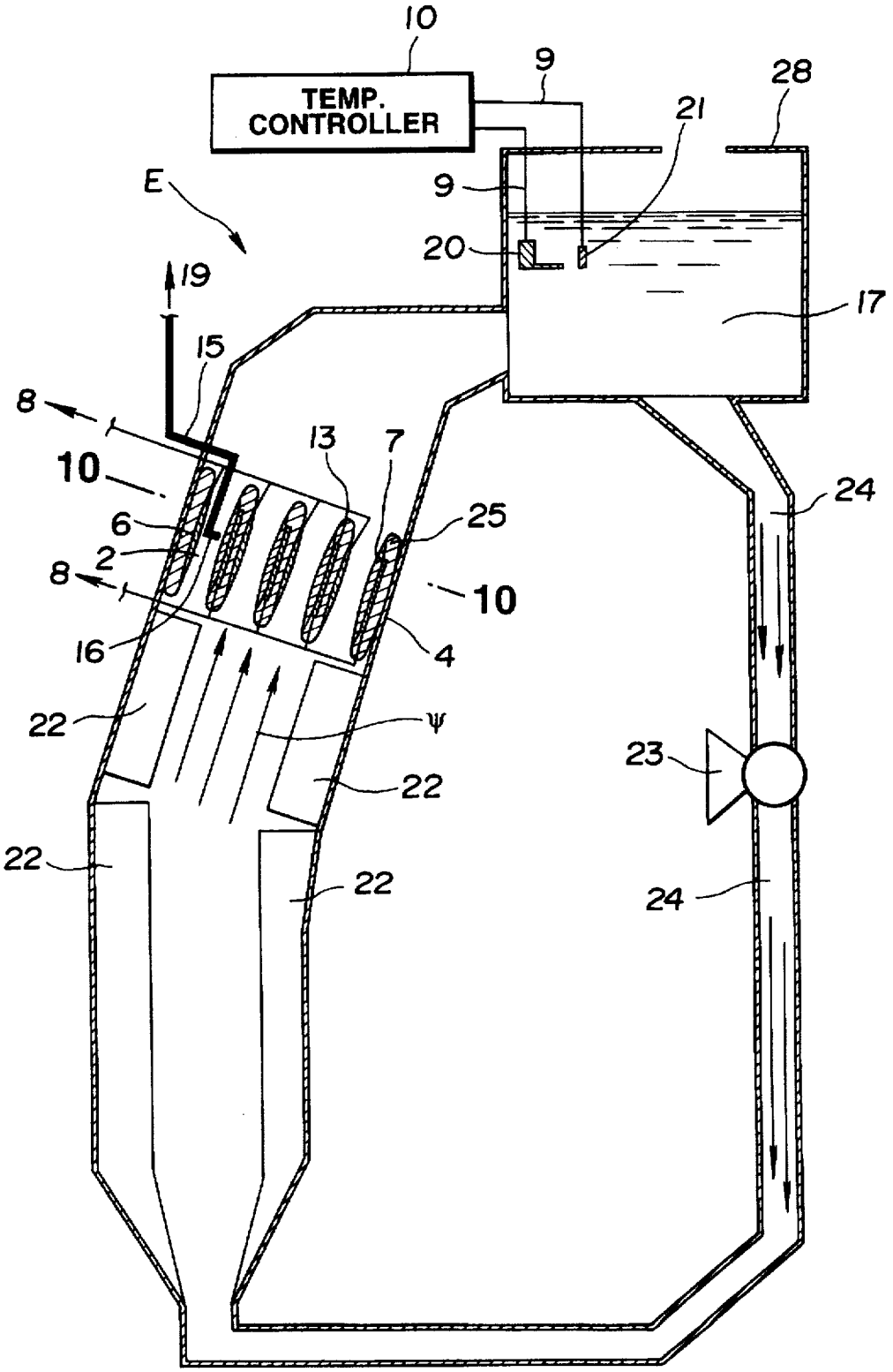
FIG. 9 is a schematic vertical sectional view of an electrochemical etching system for accomplishing a fifth embodiment of the electrochemical etching process according to the present invention.
Figure 10:
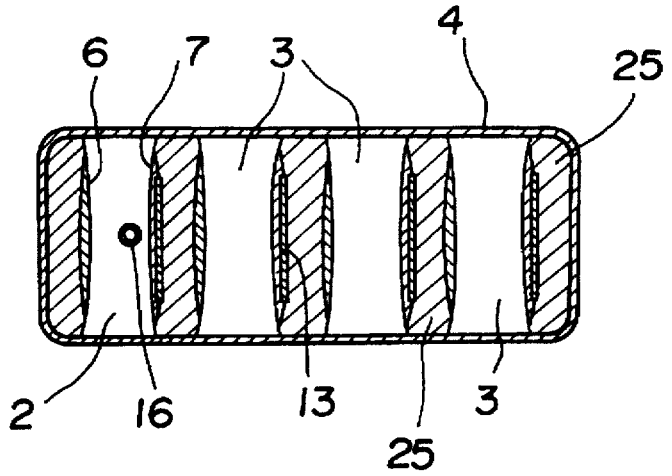
FIG. 10 is a schematic sectional view taken substantially along the line 10—10 of FIG. 9.

FIGS. 9 and 10 illustrate a fifth embodiment of the electrochemical etching process according to the present invention, similar to that of the second embodiment of FIGS. 3 and 4. In this embodiment, the etching process is accomplished by the electrochemical etching system E which includes the conduit type electrolysis vessel 4 disposed in the etching solution circulation conduit 24. The electrolysis vessel 4 of this embodiment is generally rectangular in cross-section as viewed in FIG. 10. A plurality of partition walls 25 of the generally plate-type are securely disposed inside electrolysis vessel 4 and positioned parallel with each other. In this case, one electrolysis monitoring channel 2 and three electrolysis channel 3 are formed in such a manner that each channel 2, 3 is defined between the adjacent partition walls 25. With this etching system E, four semiconductor substrates or wafers 7 can be simultaneously subjected to an etching treatment. The respective channels 2, 3 have the same dimension and are parallel with each other. Each channel 2, 3 is inclined relative to the vertical plane (not shown) in a manner to be located outward in the upward vertical direction. The semiconductor substrate 7 and the counter electrode 6 are securely disposed on the opposite side walls of each channel 2, 3 in such a manner to be parallel with each other. The semiconductor substrate 7 and the counter electrode 6 are located to have the same inclination relative to the vertical plane. As a matter of fact, the etched surface of the semiconductor substrate 7 faces the etching solution flow path formed in the channel 2, 3. Although totally four channels 2, 3 have been shown and described as being formed in this instance, it will be understood that the number of the channels 2, 3 may be two or more, in which the channels 2, 3 are arranged parallel with each other.

The flow stream of the etching solution 17 is generated by the pump 23 for circulating the etching solution 17. The pump 23 is operated to obtain a predetermined discharge flow amount, and disposed in the circulation conduit 24 which is connected to the monitoring channel 2 to constitute the etching solution flow path (not identified). The etching solution flows in the direction indicated by the symbol ψ in FIG. 9, so that the etching solution 17 upwardly flows to pass through the space between the semiconductor substrate 7 and the counter electrode 6. It will be understood that the upward flow through the monitoring channel 2 is preferably made within a laminar flow region. Additionally, baffles (flow rectifying plates) 22 are preferably formed within the etching solution flow path to vertically rectify the flow of the etching solution 17 to obtain uniform upward flow of the etching solution 17.

The etching solution tank 28 is provided in the etching solution flow path so as to be connected to the electrolysis vessel 4 and to the circulation conduit 24. The heater 20 and the temperature sensor 21 are dipped in the etching solution 17 within the tank 28, so that the etching solution can be maintained at a predetermined temperature. The tank 28 not only functions to control the temperature of the etching solution but also serves as a gas trap for preventing an excess amount of nitrogen gas from being unnecessarily circulated, the nitrogen gas being mixed in the etching solution 17 for the purpose of making replacement between gas bubbling during etching and dissolved oxygen in the etching solution so as to obtain an electrochemical stable state.

The opposed semiconductor substrate 7 and counter electrode 6 are slightly inclined in such a manner as to be located gradually outward in the upwardly vertical direction as shown in FIG. 9. This has been confirmed to be effective to promote release of bubbles generated during an electrochemical etching, from the surface of the semiconductor substrate 7 to be etched. For example, in case that the semiconductor substrate 7 and the counter electrode 6 are inclined by about 10 degrees in angle relative to the vertical plane upon using hydrazine monohydrate system etching solution, a releasing condition for the bubbles have been largely improved as compared with a case that they are vertical or not inclined. It will be understood that in order to make the etching system E further small-sized, the plurality of semiconductor substrates 7 are located to be generally vertically aligned along the inclined side wall of the monitoring channel 2, in which a plurality of the corresponding counter electrodes 6 are also similarly located.

With the above etching system E, the electrochemical control in the monitoring channel 2 is carried out generally in the same as that in the first embodiment shown in FIGS. 1 and 2. In other words, during the electrochemical etching, an electrochemical control is made in the monitoring channel 2 under the action of the Luggin capillary 16 in such a manner that an electric potential between the etched surface of the semiconductor substrate 7 and the counter electrode 6 is controlled at a predetermined value upon being monitored by the Luggin capillary 16 under the action of the potentiostat 8. The electric potential control made between the semiconductor substrate 7 and the counter electrode 6 in the monitoring channel 2 is also carried out in the remaining all channels 3 under the action of the potentiostat 8, thereby accomplishing the same etching on all the semiconductor substrates 7. The condition of the etching is determined by an electric potential control and a flow control of the etching solution in the case of an etching operation or process made for a plurality of the semiconductor substrates 7 having the same structure and the same dimension upon using the same etching solution. It will be understood that, in this instance, the respective channels 2, 3 are the same in flow condition of the etching solution, and therefore the same etching state as in the semiconductor substrate in the monitoring channel 2 can be accomplished in all the other semiconductor substrates in the electrolysis channels 3 by applying the same electric potential control as in the monitoring channel 2 to the electrolysis channels 3.

Here, effects of the above-discussed third to fifth embodiments of the etching process using the etching systems of FIGS. 5 to 10 will be discussed.

In the etching process for simultaneously etching a plurality of the semiconductor substrate or wafers, the flow condition of the etching solution can be not only easily and precisely controlled but also uniformized for the respective semiconductor substrates. Additionally, the flow condition of the etching solution can be minimized in difference or distribution within each of the monitoring and electrolysis channels. This can stabilize and optimize the electrochemical etching in each channel. Furthermore, the scale-up of the etching system can be precisely and smoothly achieved to be compatible with etching treatment of large-sized and a large number of semiconductor substrates. An etching treatment can be stably accomplished for the large-sized semiconductor substrates and simultaneously accomplished for a plurality of the semiconductor substrates at a high throughput and at a high yield. Furthermore, in accordance with the monitored result of electrochemical control for one or more pairs of the semiconductor substrate and the counter electrode, a plurality of other pairs of the semiconductor substrate and the counter electrode are simultaneously controlled in electric potential to be applied. This make it possible to accomplish etching for the plural semiconductor substrates stably and uniformly throughout the surface (to be etched) of each semiconductor substrate without causing an uneven etching, thereby largely improving productivity of etched semiconductor substrates.

In case that the etching system is provided with a plurality (for example, eight) of the channels, two channels located every third channel are arranged to serve as the monitoring channels, or otherwise four channels located every second channel are arranged to serve as the monitoring channels. In this case, the adjacent one to three channels may be simultaneously controlled in accordance with an electric potential at one monitoring channel, or otherwise such a control may be made in accordance with an average value of the electric potentials at two to four monitoring channels. These control manners may be employed to be compatible with the characteristics of the respective etching systems, such as etching solution flowing characteristics revealed under the characteristics of the used etching solution system, the shape of sections of the etching system and the precise degree in machining process. As a manner of course, the production cost can be lowered as the number of the monitoring channels reduces.

As appreciated from the above, according to the above-discussed first to fifth embodiments, a uniform etching treatment can be effectively accomplished throughout the surface of a semiconductor substrate to be etched in a high reproducibility. Additionally, a plurality of semiconductor substrates can be effectively and stably etched simultaneously in a high controllability and in a high operational or etching efficiency. As a result, microsensors such as acceleration sensors and pressure sensors, microelectronics devices, and micromechanical structures and the likes can be produced on a mass scale and in a low production cost.

Particularly according to the first and third embodiments, the etching system can be made small-sized thereby saving a space required for the etching system in a manufacturing factory. This is very advantageous from the view point of saving the space of a clean room (for semiconductor production) which has recently remarkably increased in production cost.

Particularly according to the second, fourth and fifth embodiments, the amount of the etching solution can be easily increased thereby suppressing a change in concentration of the etching solution between a time before the etching treatment and a time after the etching treatment. This makes it possible to carry out etching stably for many semiconductor substrates. Particularly according to the third and fourth embodiments, the respective channels are arranged circular and symmetrical and therefore can be easily kept in the same operational conditions. Accordingly, these embodiments are suitable for simultaneously etching a plurality of semiconductor substrates. Particularly according to the fourth embodiment, the cross-sectional area of the electrolysis vessel can be suppressed small although the number of semiconductors to be etching-treated is large.

While only the upward flow of the etching solution has been shown and described as being formed through each channel in the first to fifth embodiments, it will be appreciated that a downward flow of the etching solution may be formed through each channel particularly in order to overcome such a difficulty that the etching is degraded with distribution of bubbles existing between the etched semiconductor substrate and the counter electrode depending upon kinds of etching solution systems. More specifically, the downward flow of the etching solution may accelerate removal of bubbles as compared with the upward flow, in which the downward flow applies to the bubbles a counter force against the buoyant force of the bubbles. In this case, it may be effective that the counter electrode is formed mesh-like so as to prevent bubbles from moving along and in contact with the surface of the counter electrode. Thus, the flow direction of the etching solution through each channel may be downward.

It will be understood that the principle of the present invention is applicable to wet chemical removal-processing treatment processes (such as etching) made on the surfaces of plate-type members formed of semiconductor or the like, using an etching solution of, for example, a hydrofluoric acid system, a hydrofluoric acid-nitric acid solution system, a salt solution system containing a salt such as ammonium fluoride, and also applicable to film deposition treatment processes. Additionally, it will be appreciated that the principle of the present invention may be applicable to a treatment process which is combined with an etching process assisted by light energy.

Figure 15:
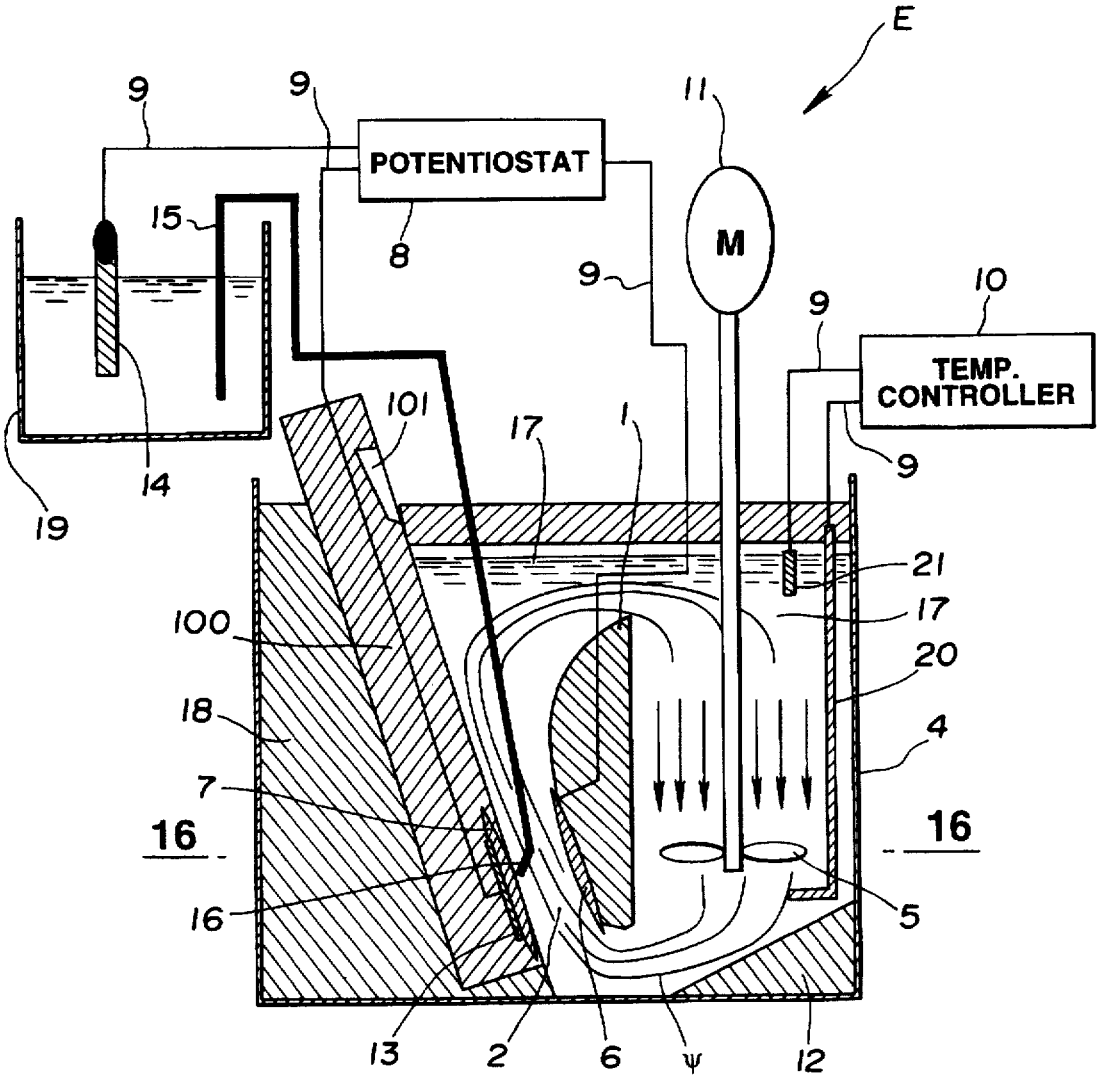
FIG. 15 is a schematic vertical sectional view of an electrochemical etching system for accomplishing a sixth embodiment of the electrochemical etching process according to the present invention.
Figure 16:
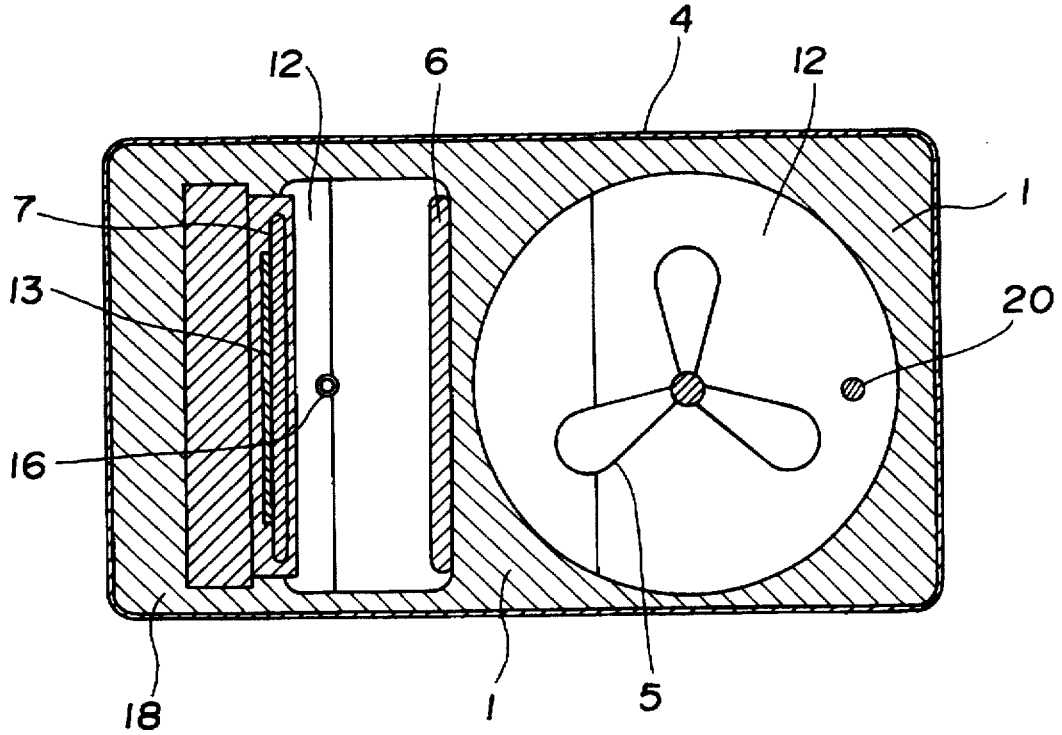
FIG. 16 is a schematic sectional view taken substantially along the line 16—16 of FIG. 15.

FIGS. 15 and 16 illustrate a sixth embodiment of the electrochemical etching process according to the present invention, which is similar to the first embodiment of FIGS. 1 and 2. The etching process of this embodiment is accomplished by an electrochemical etching system E shown in FIGS. 15 and 16 in which only essential parts are shown omitting peripheral devices. An explanation will be made on a case that a disc-shaped semiconductor substrate 7 is subjected to an etching treatment. The etching system E includes the electrolysis vessel 4 having the generally rectangular cross-section. The etching solution 17 is filled in the electrolysis vessel 4. The partition wall 1 is formed in the electrolysis vessel 4 to define a generally cylindrical space (no numeral) in which the stirring rotor 5 of the propeller type is rotatably disposed. The stirring rotor 5 includes a plurality of blades (not identified) and constitute a flow stream generating section (not identified) for the etching solution 17 in combination with the cylindrical space. The electrolysis monitoring channel 2 is formed outside and separate from the cylindrical space and defined between the inside and outside walls (not identified) which are parallel with each other and inclined relative to a vertical plane (not shown). The counter electrode 6 is securely disposed or mounted on the inside wall forming part of the partition wall 1.

A generally rectangular plate-type holder 100 for the semiconductor substrate 7 is fitted in the flow rectifying wall 18 to constitue the outside wall (no numeral) which faces the inside wall. The holder 100 is arranged to be easily detachable from the wall 18. The electrolysis monitoring channel 2 is formed between the inside and outside walls. The holder 100 is formed of a material which is highly resistant to the etching solution 17, for example, a fluorine-contained resin. The semiconductor substrate 7 is securely mounted or held on the holder 100. The holder 100 with the semiconductor substrate 7 is arranged such that the etching solution 17 attacks only an etched region at the surface of the semiconductor substrate 7 without attacking the other regions. In this connection, a part of the semiconductor substrate 7 other than the etched region, electrical connection parts (not shown) and the lead wires 9 are located within a cover casing (not shown) formed of a material highly resistant to the etching solution, such as a fluorine-contained resin. The holder 100 is formed with a groove 101 to be used when the holder 100 is attached to and detached from the wall 18. The counter electrode 6 and the semiconductor substrate 7 are parallel with each other and inclined along with the inside and outside walls of the electrolysis monitoring channel 2. The Luggin capillary 16 is set in such a manner that its tip end is located adjacent the semiconductor substrate 7. The surface (to be electrochemically etched) of the semiconductor substrate 7 faces a fluid flow region within the electrolysis monitoring channel 2. The etching solution flows through the fluid flow region.

The stirring rotor 5 is drivably connected to the variable rotational speed motor 11 thereby controlling a circulating flow stream of the etching solution 17. The etching solution 17 flows in a direction indicated by a symbol $\psi$ in FIG. 15 throughout the etching solution flow path (not identified) including the cylindrical space in which the stirring rotor 5 is disposed, the lower flow passage (not identified) defined above the bottom flow rectifying wall 12, and the flow region in the electrolysis monitoring channel 2, and the upper flow passage (not identified) defined over the central portion of the partition wall 18. Upon rotation of the stirring rotor 5 in a predetermined direction under the action of the motor 11, the etching solution 17 flows circulatingly in the direction $\psi$ from the lower side to the upper side of the vessel 4, so that the flowing etching solution 17 passes upwardly through the electrolysis monitoring channel 2 and through a space between the counter electrode 6 and the semiconductor substrate 7.

The opposed semiconductor substrate 7 and counter electrode 6 are slightly inclined in such a manner as to be located outward in an upward and vertical direction. This has been confirmed to be effective to promote release of bubbles generated during an electrochemical etching, from the semiconductor substrate 7 to be etched. For example, in case that the semiconductor substrate 7 and the counter electrode 6 are inclined by about 10 degrees in angle relative to the vertical plane upon using the hydrazine monohydrate system etching solution (in which hydrazine monohydrate is used as the etching solution), a releasing condition for the bubbles has been largely improved as compared with a case that they are vertical or not inclined.

The Luggin capillary 16 is connected through the salt bridge 15 with the etching solution 17 in a reference electrode vessel 19, so that an ionic conduction can be made between the electrolysis vessel 4 and the reference electrode vessel 19. The reference electrode 14 is dipped in the etching solution 17 in the reference electrode vessel 19. The reference electrode 14, the counter electrode 6 and the semiconductor substrate 7 are connected through the outside lead wires 9 to the potentiostat 8 disposed outside the vessels 4, 19. The lead wire 9 is connected to the semiconductor substrate 7 through the metallic electrode 13 formed on the surface of the substrate 7. During the electrochemical etching, an electrochemical control is made in the monitoring channel 2 under the action of the Luggin capillary 16 in such a manner that an electric potential between the etched surface of the semiconductor substrate 7 and the counter electrode 6 is controlled at a predetermined value upon being monitored by the Luggin capillary 16 under the action of the potentiostat 8. The etching solution 17 in the vessels 4, 19 is maintained at a predetermined temperature as occasion demands by using the temperature controller 10 which is arranged to control the temperature of the heater 20 in accordance with the temperature of the etching solution 17 detected by the temperature sensor 21.

While the etching system of the so-called triple-pole type (having a working electrode or the semiconductor substrate, the reference electrode and the counter electrode) has been shown and described in the embodiment, it will be appreciated that the principle of the present invention may be applicable to another electrochemical etching system of the dual-pole type (without the reference electrode), and to a further electrochemical etching system of the dual-pole type and of the quadruple-pole type using four poles in order to make a bias control to both conductivity type (n-type and p-type) regions in case of selectively etching, for example, only the p-type region or the working electrode of the semiconductor substrate, leaving the other conductivity type (n-type) region unetched. It will be understood that in order to make the etching system E further small-sized, the plurality of semiconductor substrates 7 are located to be generally vertically aligned along the inclined side walls of the monitoring channel 2, in which a plurality of the corresponding counter electrodes 6 are also similarly located.

An example of operation of the etching system E of FIGS. 15 and 16 will be discussed hereinafter.

In order to initiate the operation of an electrochemical etching, it is first carried out to stabilize the temperature of the etching solution 17 and securely set the peripheral devices. Subsequently, the semiconductor substrate 7 to be etching-treated is set on the holder 100, and then the lead wire 9 is connected to the holder 100 in such a manner as to be electrically connected to the semiconductor substrate 7. An operator (not shown) holds the holder 100 in such a manner that a finger of the operator catches the groove 101 of the holder 100, and quickly sets the holder 100 to be fitted at a fitting portion of the wall 18 so that the semiconductor substrate 7 is dipped in the etching solution 17. Then, the etching treatment is accomplished on the surface of the semiconductor substrate 7. After completion of the etching treatment, the operator holds the holder 100 in such a manner that the finger of the operator catches the groove 101, and quickly takes the holder 100 out of the fitting portion. The holder 100 with the etched semiconductor substrate 7 is dipped in a rinsing solution which has been prepared. Then, an electrical connection through the lead wire 9 is cut, and the etched semiconductor substrate 7 is removed from the holder 100, thereby completing a series of the above etching treatment steps. Such etching treatment in the scale of mass production is made by repeating the series of the etching treatment steps. A manner of setting the semiconductor substrate 7 on the holder 100 will be discussed after.

Figure 17:
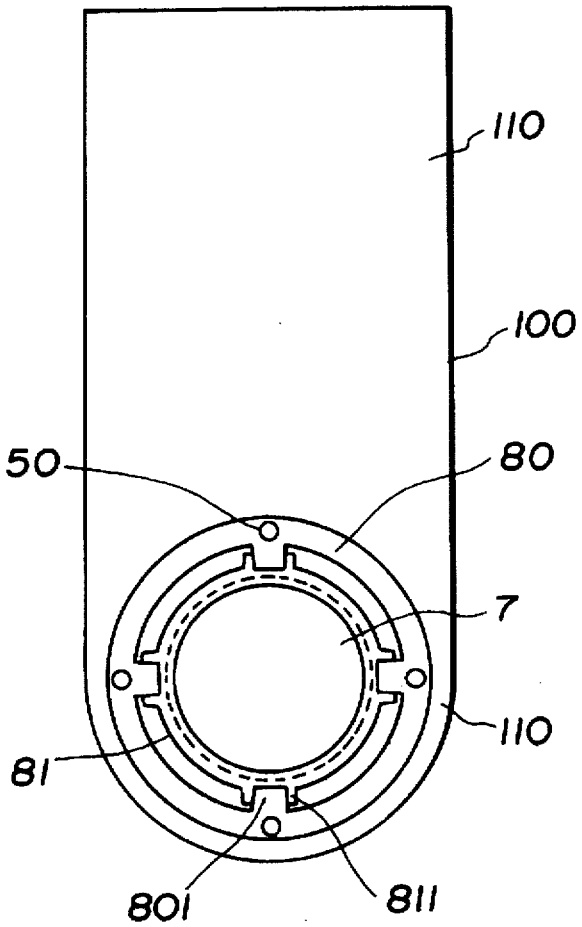
FIG. 17 is a front view of an example of a holder for the semiconductor substrate, to be used in the etching system of FIG. 16.
Figure 18:
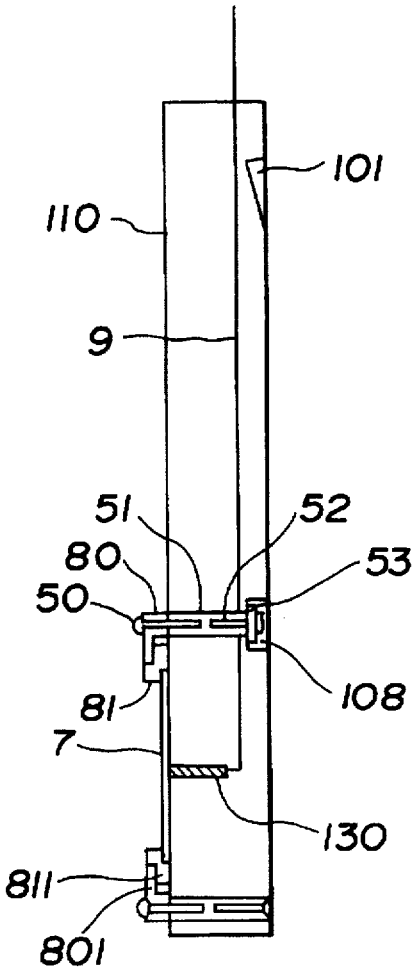
FIG. 18 is a side view of the holder of FIG. 17.

FIGS. 17 and 18 show an example of the holder 100 provided with the semiconductor substrate 7, to be used in the etching system E of FIGS. 15 and 16. In this example, the semiconductor substrate 7 is fixed onto a surface 110 (facing the etching solution flow path) of the holder 100 by a ring 81. The ring 81 is in turn fixed onto the semiconductor substrate 7 by a ring 80. More specifically, the ring 80 is integrally formed with pressing claws pr projections 801 each having a L-shaped cross-section, which claws 801 press down fixing claws or projections 811 of the ring 81 so that the semiconductor substrate 7 is fixed onto the surface 110 of the holder 100 through the ring 81 by the ring 80. The ring 80 is tightly installed onto the surface 110 of the holder 100 by means of screws or bolts 50. An installation operation of the semiconductor substrate 7 is carried out as follows: First, the semiconductor substrate 7 is located at a predetermined position on the surface 110 of the holder 100. The ring 81 is located on the semiconductor substrate 7 and rotated in such a manner that the fixing claws 811 of the ring 81 are forced beneath the claws 801 of the ring 80. A liquid-tight sealing member such as an O ring may be disposed between the ring 81 and the semiconductor substrate 7, and/or the surface 110 of the holder 100 and the semiconductor substrate 7, thereby effectively establishing a condition in which only the etching region (a circular region encircled by the ring 81 in FIG. 17) is exposed to the etching solution 17.

In this example, a contact electrode 130 is disposed in contact with the semiconductor substrate 7 and connected through the lead wire 9 with the potentiostat 8 so that a bias for the electrolysis is applied to the semiconductor substrate 7. The lead wire 9 may be inserted through a hole (not shown) formed in the resin of the holder 100, the hole being prevented from being supplied with the etching solution 17. The lead wire 9 may be embedded in the material (resin) of the holder 100 by inserting it during molding of the holder 100. Installation of the semiconductor substrate 7 accomplishes a) a fluid-tight sealing for the back side surface of the semiconductor substrate, b) a fluid-tight seal for an electric system including the lead wire 9 and the contact electrode 130, and c) an electrical connection between the semiconductor substrate 7 and the contact electrode 130, thereby effectively achieving a preparation operation for the etching. Such functions a) to c) may be accomplished by other operations.

Figure 20:
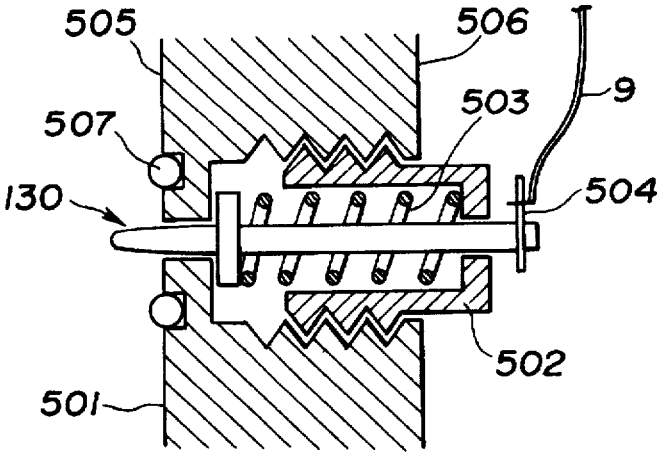
FIG. 20 is a fragmentary vertical sectional view similar to FIG. 19 but showing another example of the contact electrode.

In this example, while the lead wire 9 has been shown and described as being passed through the holder 100, it may disposed outside the holder 100, in which the lead wire 9 is covered with a sealing tube (such as a Teflon tube) to be sealed off from the etching solution. Additionally, although the semiconductor substrate 7 has been shown and described as being arranged such that only one side surface thereof is exposed to the etching solution 17 while the back side surface is sealed in a fluid-tight manner, it will be understood that the opposite side surfaces of the semiconductor substrate 7 may be exposed to the etching solution 17 by using a fluid-tight seal member 507 such as an O ring which is disposed between a section surrounding the contact electrode 130 and the correspond section of the semiconductor substrate 7, as shown in FIG. 20. By allowing the opposite sides of the semiconductor substrate 7 to be exposed to the etching solution 17, the etching treatment can be made on the opposite side surfaces of the semiconductor substrate 7. Additionally, liquid pressures acting on the opposite side surfaces of the semiconductor substrate 7 can be balanced, and therefore cracking may be prevented from occurrence even in case of etching the semiconductor substrate of the very thin diaphragm type. In such a case, the back side surface of the semiconductor substrate may be hermetically sealed off from the etching solution 17 while being supplied with a liquid pressure (equal to the pressure to be applied to the right side surface thereof) by being exposed to a liquid such as pure water.

While only one contact electrode 130 has been shown as being disposed in contact with a central portion of the back side surface of the semiconductor substrate 7, it will be appreciated that the contact electrode 130 may be located in contact with a peripheral portion of the back side surface of the semiconductor substrate 7, and a plurality of contact electrodes may be used. Even in case of disposing the contact electrode 130 at a peripheral portion or a TEG (test element group) region of the semiconductor substarte or wafer from which products (etched semiconductor substrates) are not taken out, a sufficient number of tips or products can be obtained. In case of using a plurality of contact electrodes 130 as mentioned above, a potential distribution formed in the etching surface of the semiconductor substrate 7 under the effect of an i-R drop can be suppressed at a low degree, thereby improving the yield of the products.

Figure 19:
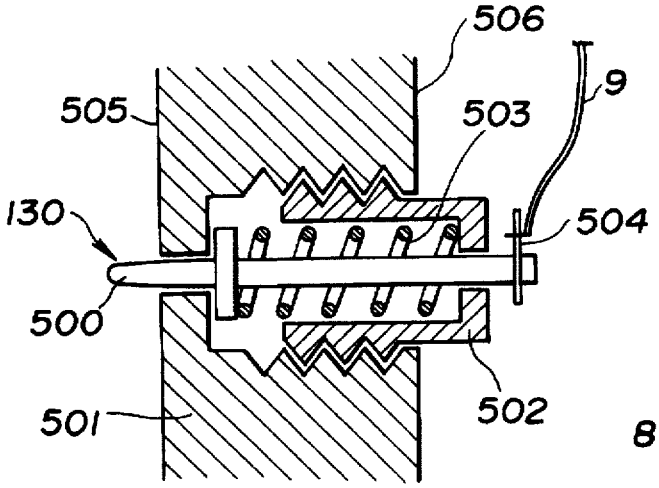
FIG. 19 is a fragmentary vertical sectional view showing an example of a contact electrode to be used in the etching system of FIGS. 15 and 16.

An example of the contact electrode 130 is shown in FIG. 19. The contact electrode 130 is installed at a portion 501 forming part of the holder 100. The portion 501 has a surface 505 to which the semiconductor substrate 7 is to be installed. The portion 501 is formed with a surface 506 located inside the holder 100 and opposite to the surface 505. An electrode pin 500 is electrically connected through a lug plate 504 to the lead wire 9 and biased toward the surface 505 by a compression spring 503. When the semiconductor substrate 7 is installed to the surface 505, the electrode pin 500 is brought into contact with the back side surface of the semiconductor substrate 7 under the bias of the compression spring 503, thereby establishing an electrical connection between the semiconductor substrate 7 and the electrode pin 500. The compression spring 503 is supported at its one end by a generally cup-shaped member 502 which is screwed in the portion 501 so that a force at which the electrode pin 500 is pressed onto the semiconductor substrate 7 can be adjusted. It will be understood that an outside stress applied to the semiconductor substrate 7 from the electrode pin 500 is increased to provide the possibility of the semiconductor substrate being broken in case that the above force due to the compression spring 503 is too high, whereas a high contact resistance is developed between the semiconductor substrate 7 and the electrode pin 500 to provide the possibility of the electrical connection being not able to be established thereby making impossible the electrochemical etching itself in case-the above force is too low.

While the compression spring 503 has been shown and described as being used to bias the electrode pin 500, it will be understood that the compression spring 503 may be replaced not only with a helical tension spring, a plate spring or the like but also with an elastomeric member such as a rubber member. Additionally, the electrode pin 500 may be biased under hydraulic pressure, pneumatic pressure, or magnetic force. The above-mentioned cup-shaped member 502 may be fixed to be not movable, or integral with the holder 100. The electrode pin 500 may be provided at its tip end with a plurality of minute projections (or micro contacts) so that the electrical contact with the semiconductor substrate can be achieved under a smaller contact pressure.

Another example of the contact electrode 130 is shown in FIG. 20 and similar to the example of FIG. 19 with the exception that an O ring 507 is used to make a sealing between the portion 501 and the semiconductor substrate 7. More specifically, the portion 501 is formed at its surface 505 with an annular groove (not numeral) in which the O ring 507 is fitted. The O ring 507 is in sealing contact with the back side surface of the semiconductor substrate 7. This arrangement makes it possible that the opposite side surfaces of the semiconductor substrate 7 are exposed to the etching solution 17, in which the electrode pin 500 is prevented from being exposed to the etching solution 17. The O ring 507 may be replaced with other materials or mechanisms which can prevent the etching solution 17 from penetrating into the side of the electrode pin 500.

Figure 21:
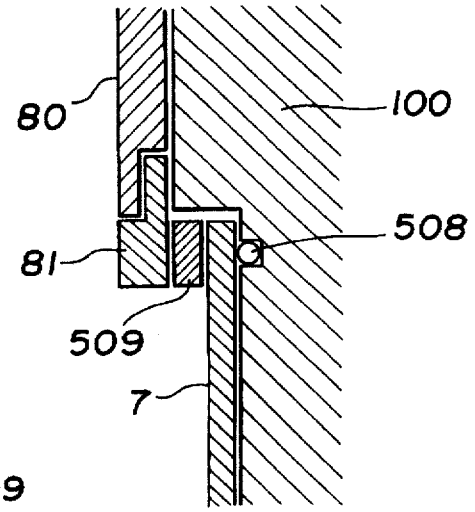
FIG. 21 is an enlarged fragmentary sectional view of an example of a part of the holder of FIGS. 17 and 18.

FIG. 21 shows an example of the relationship between the ring 81 and the semiconductor substrate 7, forming part of the arrangement of FIGS. 17 and 18. This example is intended to reduce a stress and a strain to be applied to the semiconductor substrate 7. In this example, a backup ring 509 is disposed between the ring 81 and the peripheral portion of the semiconductor substrate 7. An O ring 508 is disposed in contact with the peripheral portion of the back side surface of the semiconductor substrate 7 to seal off the back side surface of the semiconductor substrate 7 from the etching solution 17. The backup ring 509 functions to adjust the clearance for installation of the semiconductor substrate 7 and therefore to adjust a force for installation of the semiconductor substrate 7. This adjusts and reduces an outside stress and a strain to be applied to the semiconductor substrate 7. As a result, the semiconductor substrate 7 can be prevented from cracking depending upon a mechanical strength lowering under the etching, while improving the yield of the wafer. Additionally, by virtue of the backup ring 509, even the semiconductor substrates 7 having different thicknesses can be installed in position. The control of the force for installing the semiconductor substrate 7 is accomplished by adjusting a torque required when the claw 811 is fitted beneath the claw 801 upon rotation of the ring 81 as shown in FIGS. 17 and 18. Otherwise, such a control may be accomplished by adjusting the clearance for installation of the semiconductor substrate 7. The backup ring 509 is formed of a material which is low in coefficient of friction and high in chemical resistance, in which a fluorine-contained resin is suitable for the material. Otherwise, the backup ring 509 may be formed of a metal such as a stainless steel, or a material in which a metal is covered with a fluorine-contained resin.

Referring back to the example of FIGS. 17 and 18, the holder 100 is formed of any material which is resistant to the etching solution 17 and can be used as a structural member. As the material of the holder 100, a fluorine-contained resin, polyvinyl chloride or a stainless steel (SUS in Japanese Industrial Standard) is suitable in case of using a basic etching solution. The fluorine-contained resin is suitable for the material in case of using a hydrofluoric acid system etching solution. The holder 100 may be formed of a stainless steel (as a structural member) covered with a fluorine-contained resin, to be intended to be resistant to any etching solution.

It is preferable that the thickness of the ring 80 and the rings 81 is as small as possible in order to prevent flow of the etching solution 17 from being disturbed. In this connection, it is also preferable that the thickness of the claws 801, 811 of the rings 80, 81 are not so thick. The rings 80, 81 including the claws 801, 811 are preferably formed of a metal such as a stainless steel, or a material which is formed by covering the metal as a structural member with a fluorine-contained resin. However, there is the possibility of the metal as the material for rings 80, 81 being not suitable because the rings 80, 81 has an attraction effect to the opposite member if they and the claws 801, 811 are formed to have a flat surface.

The holder 100 is generally large in size, and therefore the weight of the holder 100 becomes too large if the whole body of the holder 100 is formed of a metal, according to the size of the semiconductor substrate 7 to be etching-treated. This may make it impossible to manually operate the etching thereby necessitating use of a mechanical means such as a robot. In view of this, a measure for weight-lightening for the holder 100 is proposed in which the holder 100 is formed of a plate or sheet of a stainless steel; however, this requires a bending operation and a welding process thereby degrading a dimensional precision of the holder 100. In general, as discussed above, it is preferable that the holder 100 is formed of a fluorine-contained resin, while the jigs such as the rings 80, 81 are formed of the material which is formed by covering the structural member (formed of the stainless steel) with a fluorine-contained resin. Such materials are sufficiently resistant to any liquid other than a high temperature molten salt while never exhibiting the above attracting effect and being high in processing precision.

However, there is the possibility of raising problems in the combination of the holder 100 and the jigs (80, 81) formed of the above materials, in which an internal thread formed in a material or resin (not only the fluorine-contained resin) is weak in mechanical strength and in durability. This will be discussed with reference to FIG. 17. That is, when the screw or bolt 50 is loosened, the etching solution 17 unavoidably comes to the back side surface of the semiconductor substrate 7 under the etching treatment, so that the etching will be failed. This can be effectively prevented by using an embedded rod member 51 having an internal thread, embedded in the holder 100. The screw or bolt 50 is screwed in and engaged with the internal thread of the rod member 51. A screw 52 is screwed in the embedded rod member 51 from the opposite direction to the screw 50 and tightened through a support ring 53 disposed within a groove 108 formed in the holder 100 to be opened to the back side surface of the holder 100. It will be appreciated that the shape of the holder 100 may be other than that shown and described.

Figure 22:
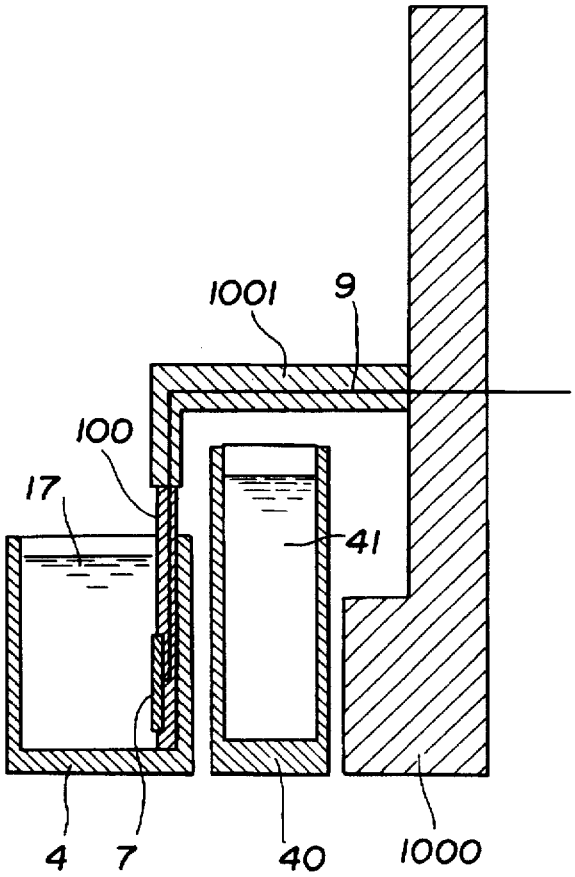
FIG. 22 is a schematic vertical sectional view showing an example of a conveying robot for the holder, to be used in combination with the etching system of FIGS. 15 and 16, illustrating an operational mode of the conveying robot.
Figure 23:
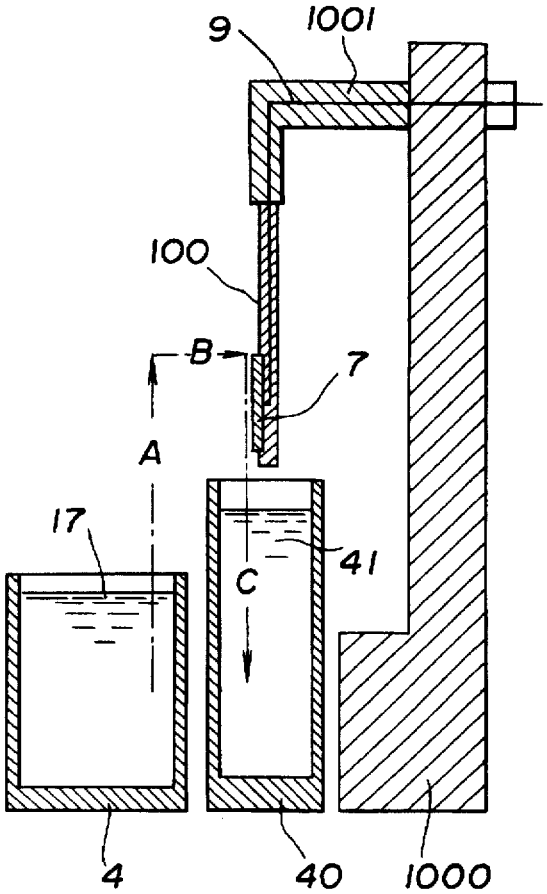
FIG. 23 is a schematic vertical sectional view similar to FIG. 22 but showing another operational mode of the conveying robot.

FIGS. 22 and 23 show an example of the above mechanical means for conveying the holder 100 during an etching operation. This mechanical means includes a conveying robot 1000 which accomplishes a conveying and carrying operation for the holder 100 during a series of operations including setting the semiconductor substrate to a position to be subjected to the etching, etching-treating the substrate, and rinsing the etched substrate. More specifically, the holder 100 provided with the set semiconductor substrate 7 is supported by an arm 1001 of the robot 1000 and set at a predetermined position in the etching solution 17 before the etching-treatment is initiated. After completion of the etching-treatment, the holder 100 is taken out from the etching solution 17 and dipped into a rinsing solution 41. In other words, the holder 100 is carried along a path indicated by dot-dash arrows A, B and C. In this case, it is not necessarily required to provide a fitting structure or portion through which the holder 100 is fitted to the inner wall of the electrolysis vessel 4. In other words, it is sufficient that the following conditions are established: The holder 100 cannot make its swinging movement during its movement by the robot arm 1001 and cannot makes its swinging movement due to flow movement of the etching solution during dipping the holder into the etching solution 17 and during etching of the semiconductor substrate 7. This may be achieved, for example, by stably fixing the holder 100 to the robot arm 1001 with bolts and nuts. Additionally, the arm 1001 of the conveying robot 1000 has a reproducibility of its controlled movement so that the holder 100 can be set always at the predetermined position in the electrolysis vessel 4.

Figure 26:
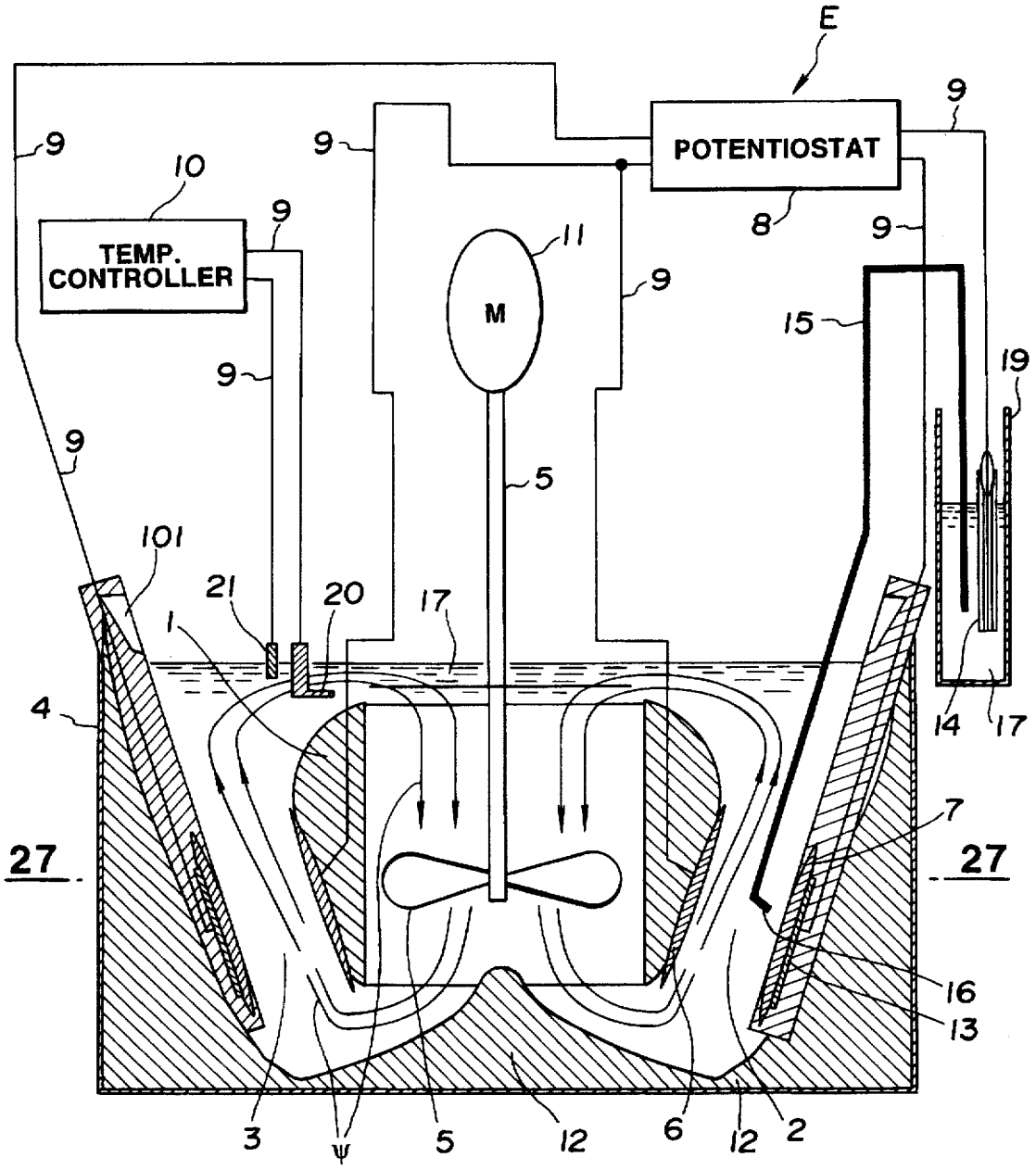
FIG. 26 is a schematic vertical sectional view of an electrochemical etching system for carrying out a seventh embodiment of the electrochemical etching process according to the present invention.
Figure 27:
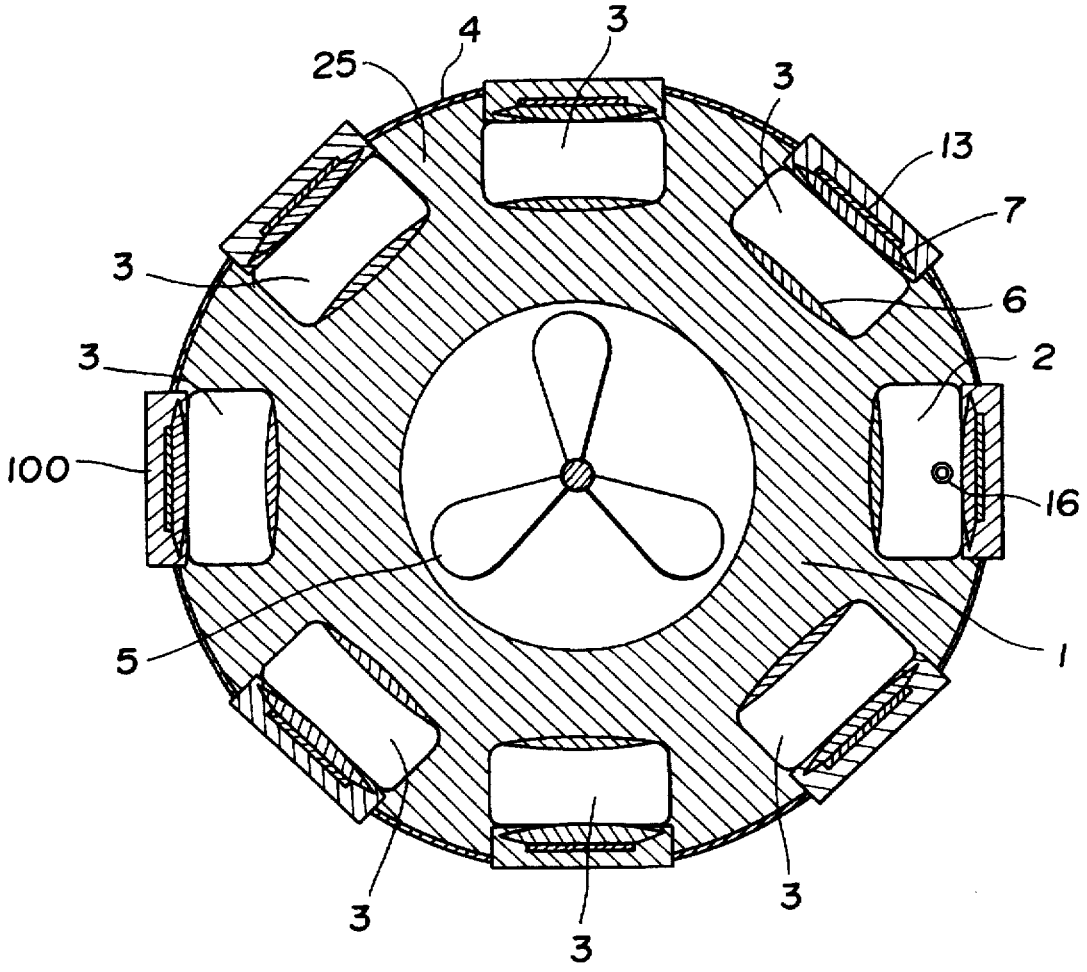
FIG. 27 is a schematic sectional view taken substantially along the line 27—27 of FIG. 26.
Figure 30:
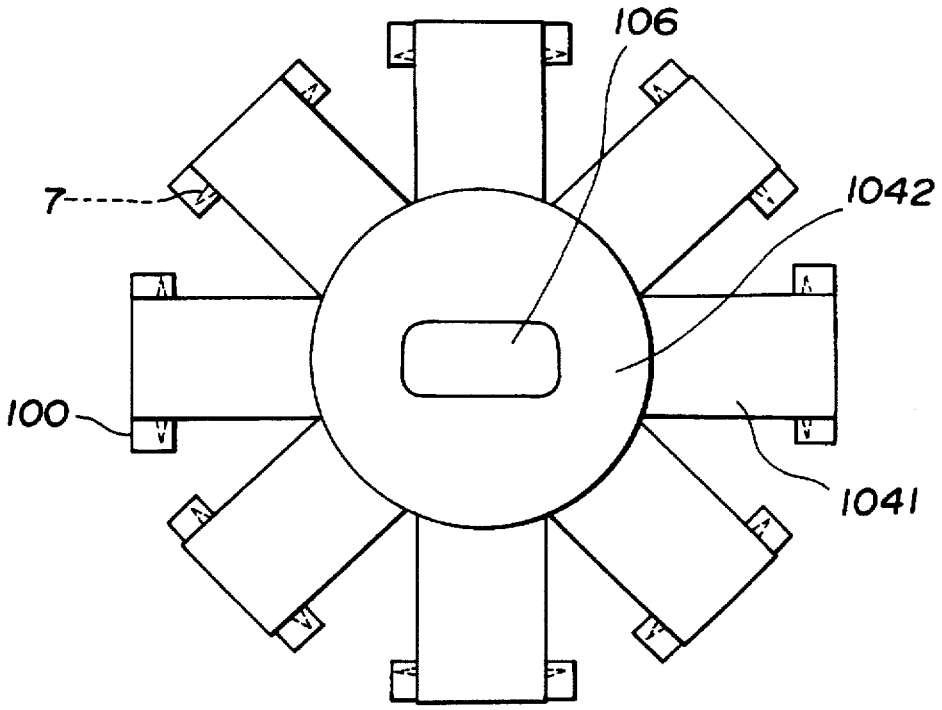
FIG. 30 is another example of the one-piece type holder assembly to be used in an electrochemical etching system similar to that of FIGS. 26 and 27.
Figure 31:
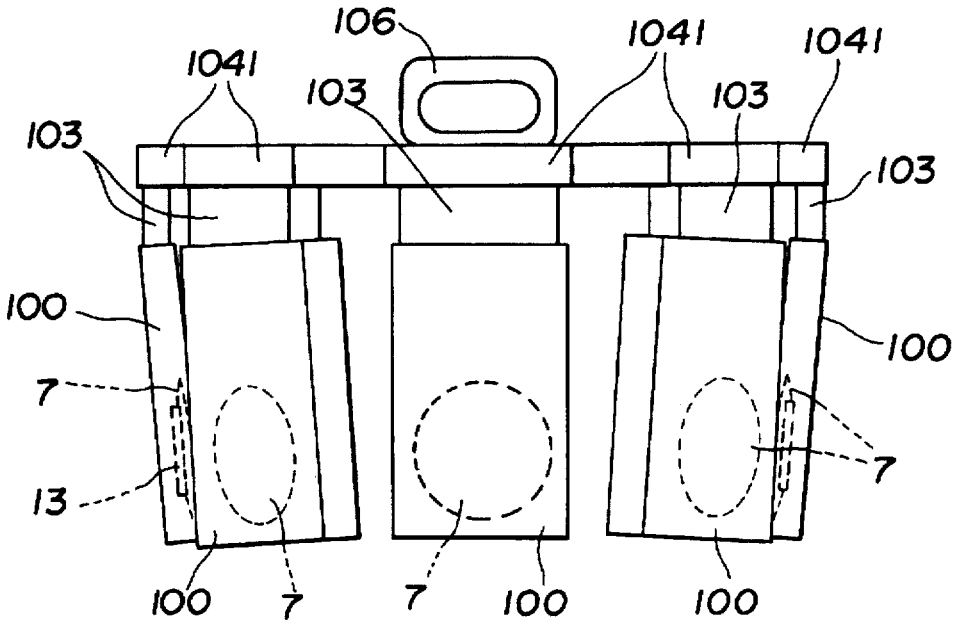
FIG. 31 is a schematic front elevation of the holder assembly of FIG. 30.

The above-discussed conveying robot 1000 may be used for the holders 100 shown in FIGS. 30A (30B), 32, 33, 34 and 35, for example, in the etching systems shown in FIGS. 26, 27 and 31. Additionally, the carrying robot 1000 may be also used for the holders shown in FIGS. 28 and 29 in an etching system in which the electrolysis monitoring channel and electrolysis channels are not inclined relative to the vertical plane.

It will be understood that the conveying robot 1000 becomes more advantageous as the size of the holder 1000 increases. In case of using the carrying robot 1000, restriction in weight and in size of the holder is softened as compared with that in case of manually accomplishing the carrying operation for the holder 100. Such a restriction is determined by the performance of the conveying robot 1000. Thus, using the conveying robot 1000 makes possible a speedy conveying of the holders shown in FIGS. 28, 29, 30A (30B), 32, 33, 34, and 35. It will be appreciated that the conveying robot 1000 will make possible an unmanned operation for etching particularly in case of using an etching solution of the dangerous system.

Figure 24:
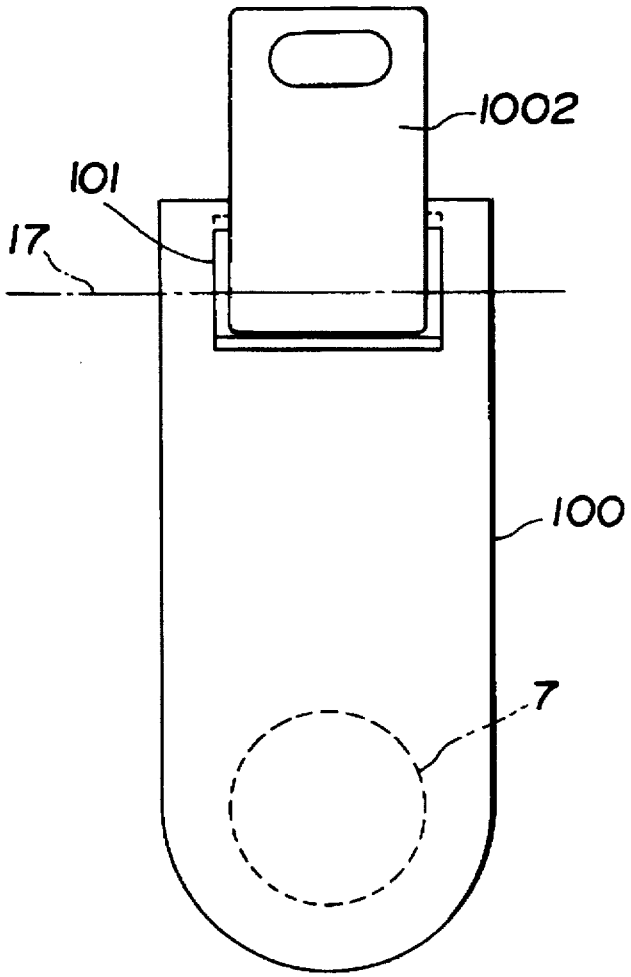
FIG. 24 is a front elevation showing an example of a pulling jig for the holder, to be used in the etching system of FIGS. 15 and 16.
Figure 25:
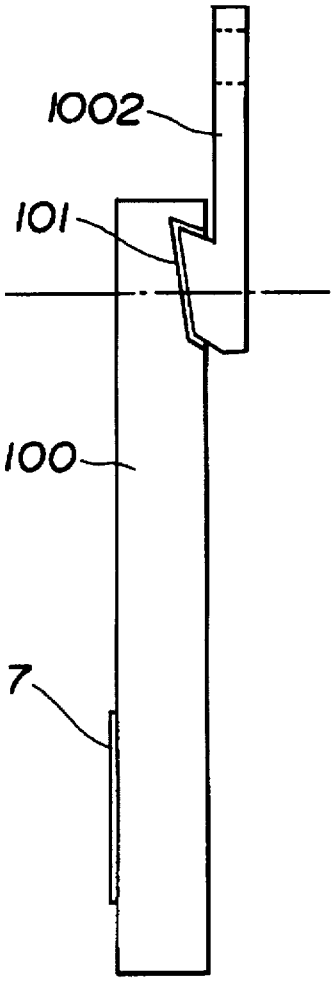
FIG. 25 is a side view of the pulling jig of FIG. 24.

FIGS. 24 and 25 show an arrangement by which the holder 100 can be manually taken out of the electrolysis vessel 4 with a jig 1002. In FIGS. 24 and 25, peripheral devices are omitted for the purpose of illustration of simplicity, so that only an essential part is shown. The front view and side views of the arrangement are shown respectively in FIGS. 24 and 25. This arrangement has been devised to overcome the difficulties encountered in case that the holder 100 becomes difficult to be handled owing to its material, shape and dimensions. More specifically, the jig 1002 for pulling the holder 100 catches the groove 101 of the holder 100 and quickly pulls the holder 100 out of the etching solution 17 upon completion of the etching. It will be understood that the holder 100 can be dipped more smoothly into the etching solution as the weight of the holder increases, so that the holder slidingly drops into the fitting structure formed inside the electrolysis vessel 4 under the action of its own weight.

Next, actual results of using the holder 100 shown in FIGS. 17 and 18 in the etching system shown in FIGS. 15 and 16 to etch a 5 inch-diameter semiconductor substrate will be discussed hereinafter. The specification of the etching system was as follows: The depth of the etching solution 17 was 25 cm; the actual volume of the etching solution 17 was about 7 liters; the distance between the electrodes 6, 7 was 4 cm; the holder 100 was located inclining 10 degrees in angle relative to the vertical plane, and parallel with the counter electrode 6 so as to constitute the inner wall (facing the counter electrode) of the electrolysis vessel 4; the electrolysis vessel 4 was of the type in which the etching solution 17 was stored; the etching solution 17 was of the hydrazine monohydrate system; and the etching operational temperature (temperature of the etching solution) was 80° C. The specification of the holder 100 was as follows: The main body was wholly made of a fluorine-contained resin; the height was 28.7 cm; the width was 16.5 cm; the thickness of the upper part was 3 cm; the thickness of a portion at which the semiconductor substrate was fixed was 2.7 cm; the upper ring 80 for fixing the semiconductor substrate was formed of a stainless steel coated with a fluorine-contained resin and had an outer diameter of 15.35 cm, an inner diameter of 14.0 cm, a thickness of 0.28 cm; the lower ring 81 for fixing the semiconductor substrate was formed of a stainless steel coated with a fluorine-contained resin and had an outer diameter of 13.9 cm, an inner diameter of 1.1 cm, a thickness of 0.28 cm; the contact electrode 130 was of the type wherein the electrode was biased by a spring, and included a platinum electrode member which was covered with a casing made of a fluorine-contained resin; lead wires were passed through the main body of the holder.

Not less than three hundreds semiconductor substrates 7 were subjected to an electrochemical etching upon use of the above-specified etching system and holder. As a result, there was no failure during the electrochemical etching, in which electrolytic corrosion and corrosion by the etching solution were not made on parts (other than parts to be etched) of the semiconductor substrate 7 and on the electric connection sections. This electrochemical etching provided a yield of not less than 90% of such a product that about four hundreds diaphragms having a thickness of 9.4±1 μm were formed on one semiconductor substrate 7. For the comparison purpose, the same electrochemical etching was made under the above conditions using a conventional etching system discussed in "2. Description of the Prior Art" of this application. As a result, there were many failures in electrochemical etching exhibiting a success rate of 20 to 30%. The yield was not higher than about 50% for products which were etching-treated incompletely.

Regarding the operationability in the above electrochemical etching, three seconds in average was required from a time at which the operator catches the groove 101 of the holder 100 with his finger to hold the holder 100 upon completion of the electrical connection to a time at which the operator dips the holder 100 in the etching solution and sets the holder at the fitting section of the inner wall 18 of the electrolysis vessel 4. Additionally, about 9 seconds in average was required from a time at which the operator catches the groove 101 of the holder 100 with his finger to hold the holder 100 upon completion of the etching to a time at which the holder 100 was quickly taken out of the fitting section of the inner wall 18 and dips the holder into the rinsing solution.

FIGS. 26 and 27 illustrate a seventh embodiment of the electrochemical etching process according to the present invention, which is similar to the sixth embodiment electrochemical etching process. The etching process is accomplished by an electrochemical etching system E as shown in FIGS. 9 and 10 in which only essential parts are shown omitting peripheral devices. In this embodiment, the electrochemical etching system E comprises the generally cylindrical partition wall 1 which is fixedly disposed in the electrolysis vessel 4. One electrolysis monitoring channel 2 and seven electrolysis channels 3 are formed radially outside of the partition wall 1 and located circularly along the outer periphery of the cylindrical partition wall 1 at equal intervals as clearly shown in FIG. 27. With this etching system E, eight semiconductor substrates or wafers 7 can be simultaneously subjected to etching treatment. The respective channels 2, 3 have the same dimension and are in the same locational relationship relative to the flow stream generating section defined inside the cylindrical partition wall 1. Each channel 2, 3 is defined between inside and outside side walls (not identified) which are inclined relative to the vertical plane (not shown) in a manner to be located outward in the upward vertical direction. The generally rectangular plate-type holders 100 for the respective semiconductor substrates 7 are fitted in the inner or flow rectifying wall 18 to constitute the outside walls facing the inside walls. Each holder 100 holds thereon a semiconductor substrate 7. The holder 100 is arranged to be easily detachable from the wall 18. The semiconductor substrate 7 and the counter electrode 6 are securely disposed respectively on the holder 100 at the outside wall and on the inside wall of each channel 2, 3 in such a manner to be parallel with each other. The holder 100 is formed of a material which is highly resistant to the etching solution 17, for example, a fluorine-contained resin. The holder 100 with the semiconductor substrate 7 is arranged such that the etching solution 17 attacks only an etched region at the surface of the semiconductor substrate 7 without attacking the other regions. The semiconductor substrate 7 and the counter electrode 6 are located to have the same inclination relative to the vertical plane. As a matter of fact, the etched surface of the semiconductor substrate 7 faces the etching solution flow path formed in the channel 2, 3. Although totally eight channels 2, 3 have been shown and described as being formed in this instance, it will be understood that the number of the channels 2, 3 may be two or more, in which the channels 2, 3 are arranged symmetrical of the axis of the cylindrical partition wall 1.

Flow stream of the etching solution 17 is generated by the stirring rotor 5 which is driven by the motor 11 whose rotational speed is controllable. The etching solution 17 flows in the direction indicated by the symbol ψ through the etching solution flow path which is defined by the cylindrical partition wall 1, the flow rectifying wall 18 and the flow rectifying bottom wall 12. The stirring rotor 5 of this instance is of the propeller type and functions to generate the flow stream of the etching solution 17 in the direction of from lower side to upper side in each channel 2, 3 upon being rotated in a predetermined direction by the motor 5. Accordingly, the etching solution 17 flows upwardly through the space between the semiconductor substrate 7 and the counter electrode 6, in which the upward flow of the etching solution is preferably made within a laminar flow region. It is preferable from a view point of flow control, that the total cross-sectional area of all the channels 2, 3 are generally equal to the cross-sectional area of the remaining part of electrolysis vessel 4 in a horizontal plane (not shown). Baffles or flow rectifying plates may be effective for rectifying vertically flow of the etching solution 17 to obtain uniform upward flow of the etching solution 17 and may be provided, for example, inside the cylindrical partition wall 1.

It will be understood that the etching system E can be made further small-sized by generally vertically aligning the plurality of semiconductor substrates 7 along the inclined side walls of the monitoring channel 2, in which a plurality of the corresponding counter electrodes 6 are also similarly located. Although the respective channels 2, 3 have been shown and described as being separate from each other by means of walls such as the rectifying bottom wall 12 and the rectifying upper wall 18, it will be appreciated that the respective channels 2, 3 may be fluidly connected with each other, or that a circular (in cross-section) channel is formed between the inner wall of the electrolysis vessel 4 and the cylindrical partition wall 1 so that a plurality of pairs of the semiconductor substrate 7 and the counter electrode 6 are disposed or set in the circular channel. In this case, a baffle or flow rectifying plate may be disposed between the adjacent two pairs of the semiconductor substrate 7 and the counter electrode 6 in a manner to extend in the direction of a normal line relative to the inner surface of the electrolysis vessel 4. This will form a stable upward flow of the etching solution 17.

With the above etching system E of FIGS. 26 and 27, the electrochemical control in the monitoring channel 2 is carried out generally in the same manner as that in the first embodiment shown in FIGS. 1 and 2. In other words, during the electrochemical etching, an electrochemical control is made in the monitoring channel 2 under the action of the Luggin capillary 16 in such a manner that an electric potential between the etched surface of the semiconductor substrate 7 and the counter electrode 6 is controlled at a predetermined value upon being monitored by the Luggin capillary 16 under the action of the potentiostat 8. The electric potential control made between the semiconductor substrate 7 and the counter electrode 6 in the monitoring channel 2 is also carried out in the remaining all channels 3 under the action of the potentiostat 8, thereby accomplishing the same etching on all the semiconductor substrates 7. The condition of the etching is determined by an electric potential control and a flow control of the etching solution in the case of an etching operation or process made for a plurality of the semiconductor substrates 7 having the same structure and the same dimension upon using the same etching solution. It will be understood that, in this instance, the respective channels 2, 3 are the same in flow condition of the etching solution, and therefore the same etching state as in the semiconductor substrate in the monitoring channel 2 can be accomplished in all the other semiconductor substrates in the electrolysis channels 3 by applying the same electric potential control as in the monitoring channel 2 to the electrolysis channels 3. The etching solution 17 in the vessels 4, 19 is maintained at a predetermined temperature as occasion demands temperature temperature controller 10 which is arranged to control the temperature of the heater 20 in accordance with the temperature of the etching solution 17 detected by the temperature sensor 21.

It will be appreciated that the operating manner of the etching system E of this embodiment is fundamentally the same as that of the etching system of FIGS. 15 to 25, and therefore the arrangements shown in FIGS. 15 to 25 may be applicable to the etching system of FIGS. 26 and 27. In case that a plurality of the holders 100 cannot be simultaneously attached or detached, it is preferable that when the etching is initiated, first the semiconductor substrate 7 for the monitor channel 2 is dipped in the etching solution 17, and then the semiconductor substrates for the electrolysis channels 3 are successively dipped in the etching solution 17 at predetermined time intervals; and when the etching has been completed, first the semiconductor substrates 7 in the electrolysis channels 3 are successively pulled up at predetermined time intervals, and finally the semiconductor substrate 7 is pulled up. This means that it is preferable that monitoring the electric potential is continued in the monitoring channel 2 as long as possible, under which the electrochemical etching is accomplished on the other semiconductor substrates 7.

While the holders 100 has been shown and described as being separate from each other in the etching system of FIGS. 26 and 27, it will be understood that a plurality of the holders 100 may be integrally connected with each other to form a one-piece type holder assembly including a plurality of the holders 100. An example of this holder assembly is shown in FIGS. 28 and 29.

Figure 28:
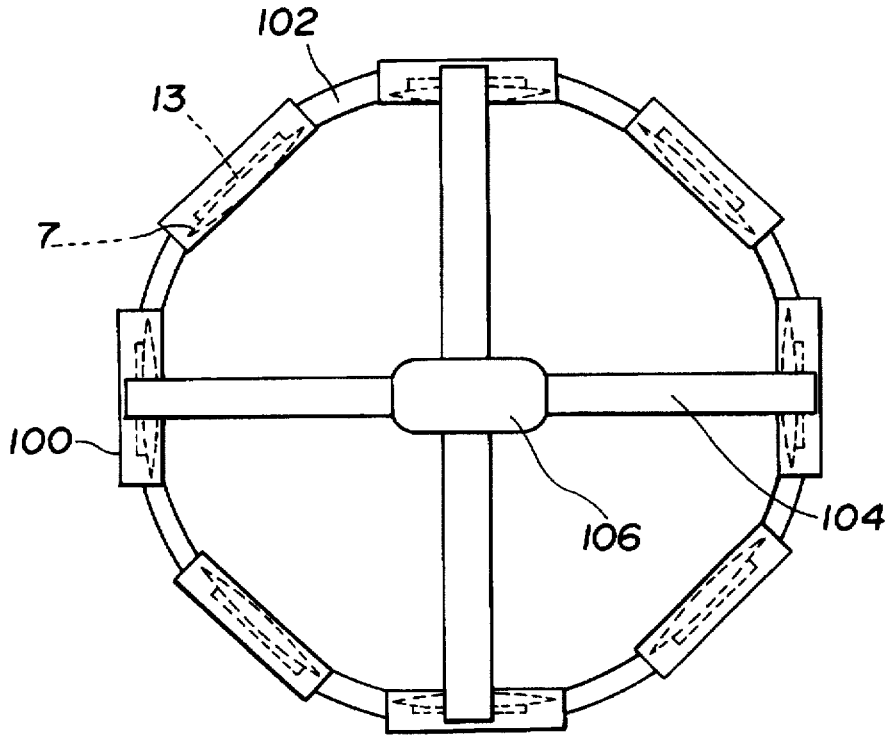
FIG. 28 is a schematic plan view on an example of a one-piece type holder assembly to be used in an electrochemical etching system which is similar to that of FIGS. 26 and 27 but provided with vertically extending electrolysis and monitoring channels.
Figure 29:
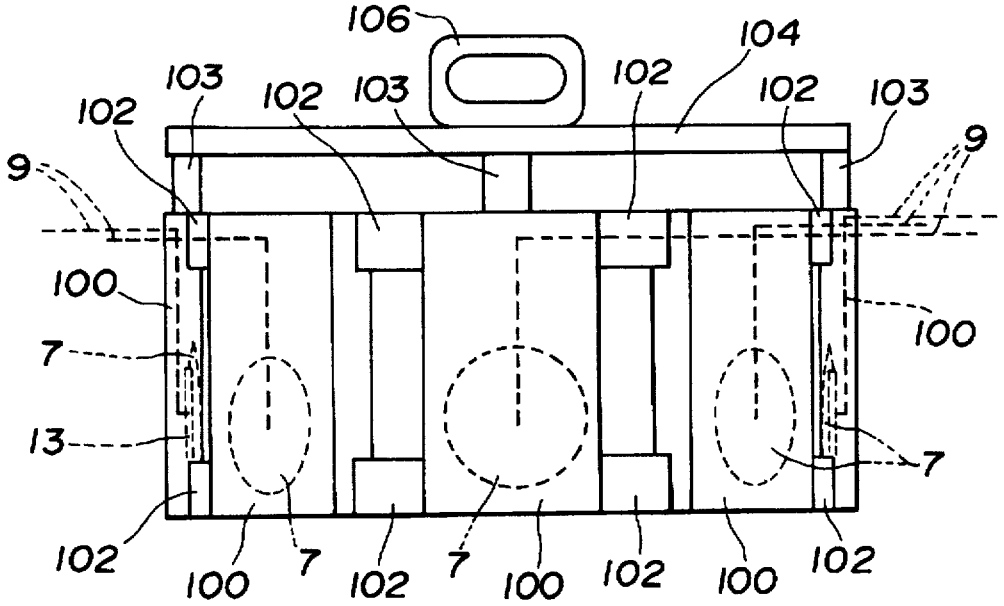
FIG. 29 is a schematic front elevation of the holder assembly of FIG. 28.

In FIGS. 28 and 29, the one-piece type holder assembly includes a plurality of the holders 100 each of which is provided with the semiconductor substrate 7. The holder assembly of this example is applied to the etching system provided with vertically extending electrolysis monitoring channels 2 and electrolysis channels 3. The holder assembly includes support arms 103, 104 for supporting the holders 100, and a holder connecting arm 102 for connecting the adjacent holders 100 with each other. A grip 106 is fixedly secured to the support arms 104, so that the holder assembly is moved upon being hanged through the grip 106. The lead wires 9 through which an electric potential is applied is disposed to pass through the resin of the holder 100 to be protected from the etching solution. While the lead wires 9 have been shown as being taken out from an upper section of each holder 100, it will be understood that the lead wires 9 may pass through the holder 100 and taken out from the support arm 103, 104, or pass through the support arm 103 and taken out from the grip 106. Additionally, the lead wires 9 may be passed through the arm 1001 of the conveying robot 1000 as shown in FIGS. 22 and 23. It will be appreciated that in case of using the one-piece type holder assembly of FIGS. 28 and 29, it is effective to move the holder assembly by using the conveying robot 1000, so that the weight and size of each holder 100 can be increased as compared with a case in which the holder assembly is operated manually.

FIGS. 30 and 31 show an another example of the one-piece type holder assembly which is similar to that of FIGS. 29 and 29 with the exception that the holders 100 are arranged to be compatible with the etching system E provided with the channels 2, 3 which extend inclined relative to the vertical plane. The holder assembly of this example includes extensible support arms 1041 fixedly secured to a central plate 1042. Each holder 100 is fixedly connected through a support arm 103 to the support arm 1041. The holder assembly of this example is effective to be applied in case that each channel 2, 3 defined between the semiconductor substrate 7 and the counter electrode 6 is narrow so that the holder assembly cannot be pulled up through the grip 106 for the reason why the lower section of each inclined holder 100 comes into contact with the opposite wall provided the counter electrode 6 according to the inclination angle of each holder 100.

In this example, by virtue of using the extensible support arms 1041, the respective holders 100 can move outwardly to increase the outer diameter of the holder assembly as the holder assembly is raised upward, so that the holder assembly can smoothly drawn out upwardly of the electrolysis vessel 4 without interference with a structure on the side of the electrolysis vessel 4. Such an arrangement makes it possible to easily apply the inclined type holders 100 to the etching system provided with the narrow channels 2, 3.

It will be appreciated that the one-piece type holder assemblies shown in FIGS. 28 to 31 are very effective for simultaneously etching-treating a plurality of semiconductor substrates.

Figure 32:
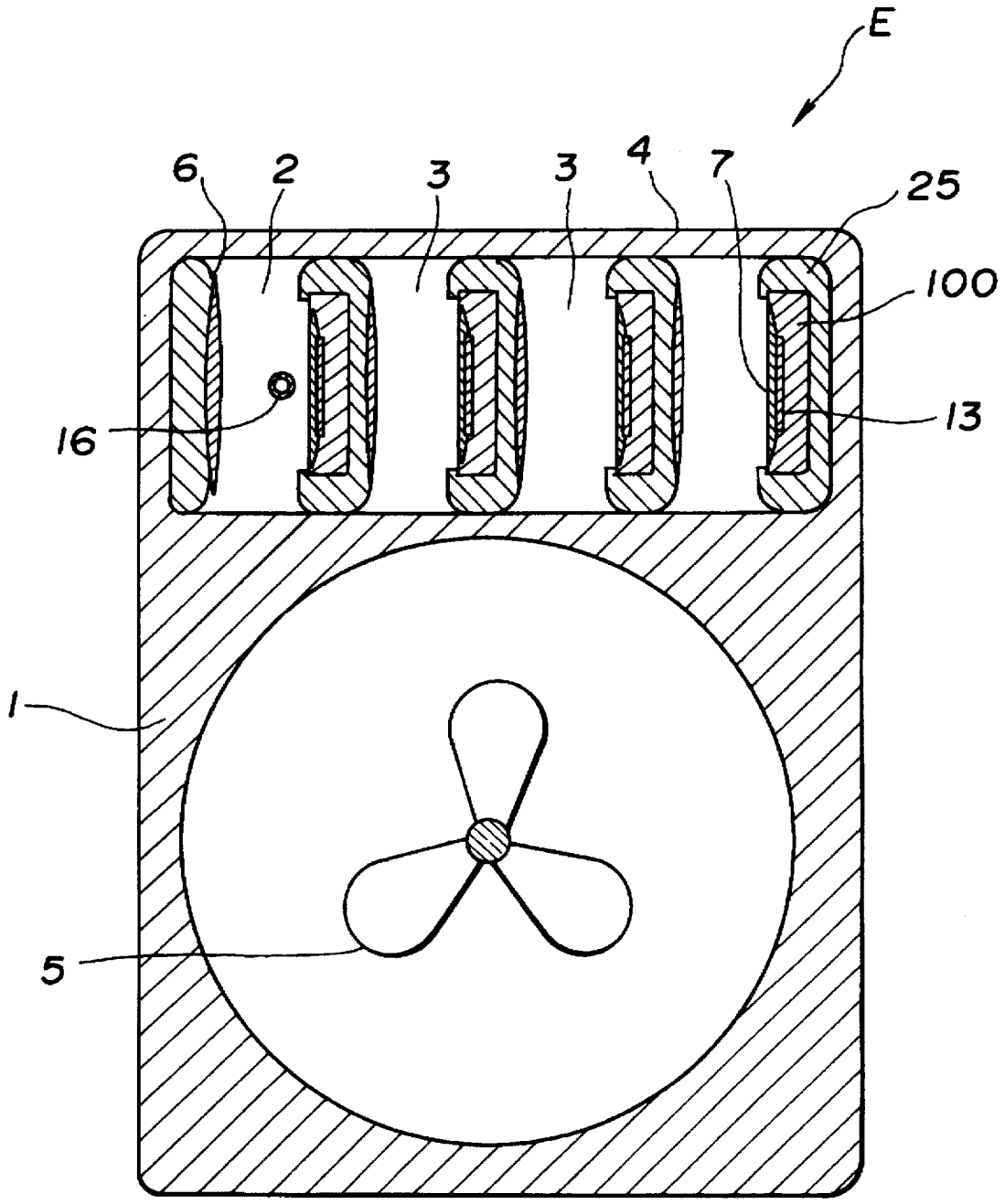
FIG. 32 is a schematic sectional view similar to FIG. 16 but showing an electrochemical etching system for carrying out an eighth embodiment of the electrochemical etching process according to the present invention.

FIG. 32 illustrates an eighth embodiment of the electrochemical etching process of the present invention, similar to that of FIGS. 15 and 16. The etching process of this embodiment is accomplished by an electrochemical etching system E shown in FIG. 32. In the etching system E, only essential parts are shown omitting peripheral devices for the purpose of simplicity of illustration. The etching system E of this instance generally corresponds to the etching system E of FIGS. 15 and 16 with the exception that a plurality of the holders 100 are disposed within the channel 2 for the purpose of improving an etching treatment efficiency. More specifically, in the etching system E of this instance, five holders 100 provided with the respective semiconductor substrates 7 are installed in position in a manner to respectively face five counter electrodes 6. It will be understood that flow of the etching solution 17 is generated by the stirring rotor 5 in the flow stream generating section. The manner of temperature control and electrochemical control of the etching system E of this instance is the same as that in the etching system of FIGS. 26 and 27 and therefore is omitted for the purpose of simplicity of illustration.

It will be understood that the structure of the etching system of this instance is small-sized as compared with that of the etching system of FIGS. 26 and 27, and that the operation by an operator can be accomplished at only one side of the etching system E. However, the etching system of FIGS. 26 and 27 is advantageous as compared with that of this instance from the view point of obtaining a uniform flow of the etching solution 17 through each channel 2, 3.

Figure 33:
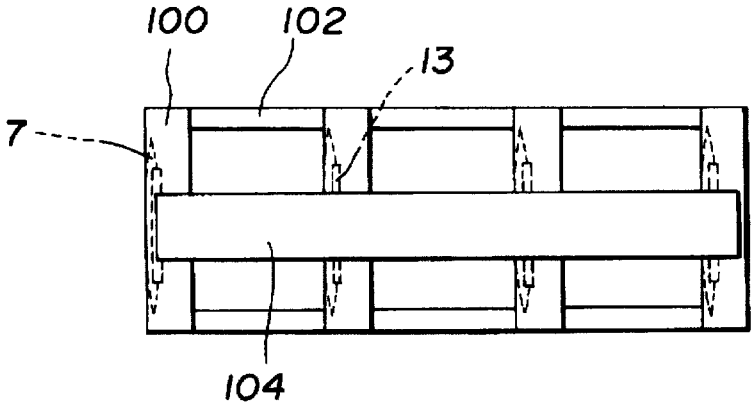
FIG. 33 is a schematic plan view of a further example of the one-piece type holder assembly to be used in the etching system of FIG. 32.
Figure 34:
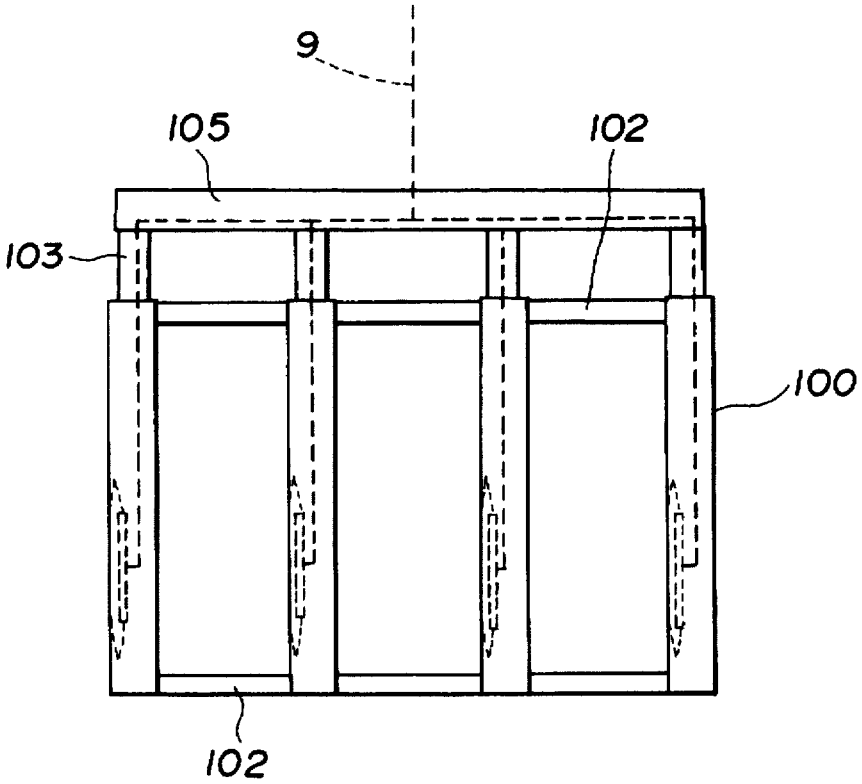
FIG. 34 is a schematic front elevation of the one-piece type holder assembly of FIG. 33.

While the holders 100 of the instance of FIGS. 32 has been shown and described as separating from each other, the holders 100 may be connected with each so as to form a one-piece type holder assembly as shown in FIGS. 33 and 34. In an example of the holder assembly of FIGS. 33 and 34, the four holders 100 supporting the respective four semiconductor substrates 7 are fixedly connected with each other through the holder connecting arms 102, and the support arms 103, 104. Additionally, a grip 105 is provided to the holder assembly so that movement of the holder assembly is achieved through the grip 105. It will be understood that using such the one-piece type holder assembly renders possible a simultaneous etching for a plurality of semiconductor substrates thereby largely improving an operational or etching-treatment efficiency. It will be appreciated that in case of using the one-piece type holder assembly of FIGS. 33 and 34, it is effective to move the holder assembly by using the conveying robot 1000, so that the weight and size of each holder 100 can be increased as compared with a case in which the holder assembly is operated manually.

Figure 35:
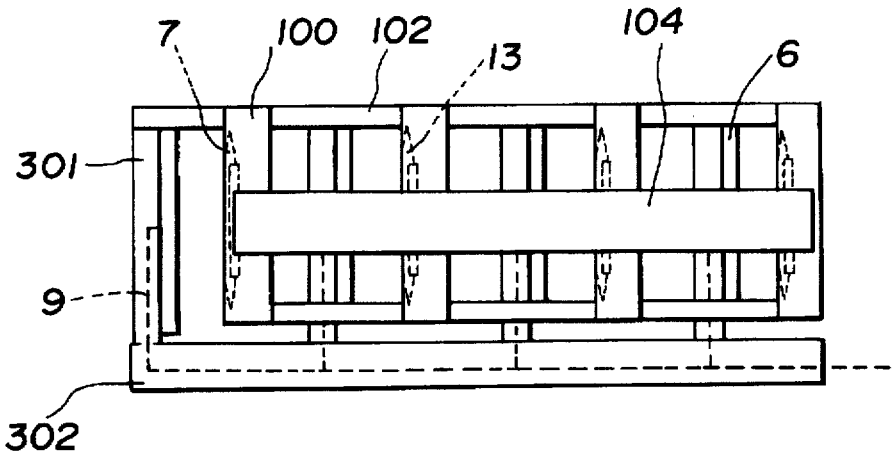
FIG. 35 is a still further example of the one-piece type holder assembly to be used in the etching system of FIG. 32.
Figure 36:
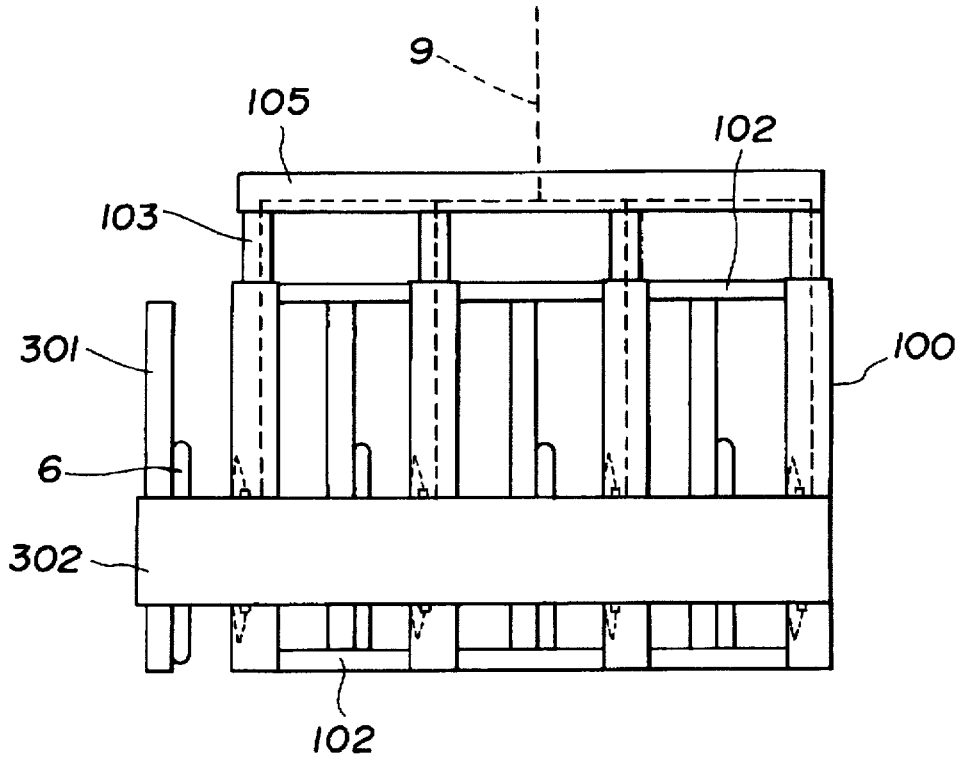
FIG. 36 is a schematic front elevation of the holder assembly of FIG. 35.

FIGS. 35 and 36 show another example of the one-piece type holder assembly which is similar to that of FIGS. 33 and 34 with the exception that the counter electrodes 6 are also assembled in the holder assembly. It will be understood that the holder assembly of this example can be used in the etching system of FIG. 32 or the like. Each counter electrode 6 is disposed on a counter electrode installation plate 301. Five counter electrode installation plates 301 are fixedly connected with each other by a connecting arm 302, and further fixedly connected with the holders 100 provided with the semiconductor substrates 7 to form the one-piece type holder assembly. This arrangement is effective in case of using the etching solution of such a system that deposit is formed on the surface of the counter electrode under an etching operation so that the counter electrode is often required to be rinsed, or in case of using the etching solution of such a system that waste of the counter electrode is much so that inspection of the counter electrode is often required after the etching-treatment.

The counter electrode installation plates 301 may be fixedly connected with the holders 100 for the semiconductor substrates 7 to establish a rigid connection with each other, so that the counter electrodes 6 and the semiconductor substrates 7 are simultaneously installed or detached, or moved. Otherwise, the counter electrode installation plates 301 and the holders 100 may be separate from each other to be handled independently from each other as occasion demands, for example, in case that the counter electrode installation plates 301 is not required to be washed so that only the counter electrode installation plates 301 are left in the electrolysis vessel 4 while only the holders 100 for the semiconductor substrates 7 are installed or detached. It will be appreciated that in case of using the one-piece type holder assembly of FIGS. 35 and 36, it is also effective to move the holder assembly by using the conveying robot 1000, so that the weight and size of each holder 100 can be increased as compared with a case in which the holder assembly is operated manually.

As appreciated from the above, particularly according to the embodiments of FIGS. 15 to 36, reproducibility of the etching treatment can be improved while not only preventing the semiconductor substrate from being damaged but also preventing the etching solution from being put into a unusable condition. Additionally, the etching processes can effectively solve conventional problems such as lowering a quality of products, providing an non-uniformity in operation, and lowering the operational efficiency, and therefore becomes suitable for a mass production operation. By using the holder for the semiconductor substrate, the semiconductor substrate can be installed at a predetermined position to be subjected to an electrochemical etching, smoothly and in a high reproducibility. This is accomplished even if the distance between the semiconductor substrate (serving as the working electrode) to be etched and the counter electrode is small.

What is claimed is:

1. An electrochemical etching process comprising the following steps:

providing first and second walls which have respectively surfaces defining therebetween a flow region of an etching solution, the surfaces of said first and second walls facing and being spaced from each other, the surfaces of said first and second walls being generally parallel with each other;

mounting a semiconductor substrate and a counter electrode on the facing surfaces of said first and second walls, respectively; and circulating the etching solution to flow through said flow region in a direction generally parallel with the facing surfaces of said first and second walls; and applying an electric potential between said semiconductor substrate and said counter electrode.

2. An electrochemical etching process as claimed in claim 1, further comprising the following steps:

forming said first and second walls in a vessel to be filled with the etching solution;

forming a section for generating a flow stream of the etching solution in said vessel, said flow stream generating section being connected with said flow region of the etching solution; and generating the flow stream of the etching solution at said flow stream generating section.

3. An electrochemical etching process as claimed in claim 2, further comprising the step of providing a partition wall between said flow stream generating section and said flow region of the etching solution.

4. An electrochemical etching process as claimed in claim 2, further comprising the step of controlling a magnitude of flow stream generation of said flow stream generating section so as to control a flow condition of the etching solution within said flow region between the facing surfaces of said first and second walls.

5. An electrochemical etching process as claimed in claim 2, further comprising the step of forming a plurality of flow channels which are similar in shape to said flow region so as to simultaneously etch a plurality of said semiconductor substrates, each flow channel being defined between third and fourth walls which are similar respectively to said first and second walls, a semiconductor substrate and a counter electrode being mounted respectively on surfaces of said third and fourth walls, said surfaces facing with each other.

6. An electrochemical etching process as claimed in claim 5, further comprising the following steps:

monitoring an electric potential of at least one semiconductor substrate; and controlling an electric potential to be applied between each of the other semiconductor substrates and the corresponding counter electrode, in accordance with the monitored electric potential, so as to simultaneously etch a plurality of the semiconductor substrates.

7. An electrochemical etching process as claimed in claim 5, further comprising the following steps:

locating said flow stream generating section at a central part of said vessel;

locating said flow region and said flow channels around said flow stream generating section; and providing a bottom wall located below said flow stream generating section, said bottom wall having a curved surface formed to smoothly guide the etching solution from said flow stream generating section toward said flow region and said flow channels.

8. An electrochemical etching process as claimed in claim 1, further comprising the step of inclining the facing surfaces of said first and second walls relative to a vertical plane.

9. An electrochemical etching process as claimed in claim 1, wherein the etching solution circulating step includes circulating the etching solution to flow upwardly through said flow region between the facing surfaces of said first and second walls.

10. An electrochemical etching process as claimed in claim 1, wherein the semiconductor substrate mounting step includes providing a holder for the semiconductor substrate, installing the semiconductor substrate to said holder, and installing said holder at a position on the surface of said first wall.

11. An electrochemical etching process as claimed in claim 10, further comprising the step of preventing a second surface of said semiconductor substrate from contacting with the etching solution, said second surface being opposite to a first surface of said semiconductor substrate to be etched.

12. An electrochemical etching process as claimed in claim 11, further comprising the step of installing a contact electrode to be in contact with the second surface of said semiconductor substrate in a manner to insulate said contact electrode from the etching solution, an electrical connection to said semiconductor substrate being established through said contact electrode.

13. An electrochemical etching process as claimed in claim 12, further comprising the step of insulating said contact electrode from the etching solution.

14. An electrochemical etching process as claimed in claim 10, further comprising the step of conveying said holder by conveying means, the holder conveying step including dipping said holder into the etching solution, and taking out said holder from the etching solution.

15. An electrochemical etching process as claimed in claim 10, further comprising the step of providing to said holder a mechanism through which a lead wire for establishing an electrical connection is installed to said holder.

16. An electrochemical etching process as claimed in claim 10, further comprising the step of providing at least one of said counter electrode and a jig for holding said counter electrode, to be incorporated with said holder.

17. An electrochemical etching process as claimed in claim 10, further comprising the step of providing a plurality of holders for the semiconductor substrates and said jigs for holding counter electrodes.

18. An electrochemical etching process as claimed in claim 17, wherein the providing step includes locating said holders, and jigs generally parallel with each other at predetermined intervals.

19. An electrochemical etching process as claimed in claim 18, further comprising the step of inclining each of said holders and jigs relative to a vertical plane.

20. An electrochemical etching process as claimed in claim 17, wherein the providing step includes locating said holders and said jigs generally circularly at predetermined intervals.

21. An electrochemical etching process as claimed in claim 17, further comprising the step of simultaneously move said holders and said jigs relative to the etching solution.

22. An electrochemical etching process as claimed in claim 10, wherein said semiconductor substrate installing step includes providing a first ring fixed to said holder and having a plurality of radially inwardly extending projections;

providing a second ring having a plurality of radially outwardly extending projections;

putting said semiconductor substrate on said holder; and locating said second ring in a position between said semiconductor substrate and said first ring in a manner that the projections of said second ring are brought into engagement respectively with the projections of said first ring.

23. An electrochemical etching process as claimed in claim 22, wherein the first ring providing step includes forming said first ring of one of a metal and a material including a metal structural member covered with a resin film, and fixing said first ring onto said holder with a threaded member.

24. An electrochemical etching process as claimed in claim 22, wherein the second ring providing step includes forming said second ring of one of a metal and a material including a metal structural member covered with a resin film.

25. An electrochemical etching process as claimed in claim 10, further comprising the following steps:

providing a plurality of holders for said semiconductor substrates;

arranging said holders generally circularly at intervals and inclined relative to a vertical plane; and supporting said arranged holders to be connected to each other to form a one-piece structure, each holder being supported through a support arm which is extensible in its axial direction.

26. An electrochemical etching process as claimed in claim 10, further comprising the step of installing to said holder a mechanism through which said semiconductor substrate comes into contact with a lead wire for establish an electrical connection, when said semiconductor is installed to said holder.

27. An electrochemical etching process as claimed in claim 10, further comprising the step of softening a stress applied to said semiconductor substrate installed on said holder.

28. An electrochemical etching process as claimed in claim 10, wherein the semiconductor substrate installing step includes locating said semiconductor substrate such that at least a part of a first surface of said semiconductor substrate is generally flush with a first surface of said holder, the first surface of said semiconductor substrate and said holder facing the etching solution to be contactable with said etching solution.

29. An electrochemical etching system comprising:

means for holding an etching solution;

first and second walls which are formed in said etching solution holding means and have respectively surfaces defining therebetween a flow region of the etching solution, the surfaces of said first and second walls facing and being spaced from each other,the surfaces of said first and second walls being generally parallel with each other, said first wall adapted to receive a semiconductor substrate;

a counter electrode mounted on the surface of said second wall;

means for circulating the etching solution to flow through said flow region in a direction generally parallel with the facing surfaces of said first and second walls; and means for applying an electric potential between said semiconductor substrate and said counter electrode.

30. An electrochemical etching system as claimed in claim 29, further comprising:

a vessel for holding the etching solution and provided therein with said first and second walls, said vessel forming part of said etching solution holding means; and means for generating a flow stream of the etching solution in said vessel, said flow stream generating means being fluidly connected with said flow region of the etching solution.

31. An electrochemical etching system as claimed in claim 30, further comprising a partition wall located between said flow stream generating section and said flow region of the etching solution.

32. An electrochemical etching system as claimed in claim 28, further comprising means for controlling a magnitude of flow stream generation at said flow stream generating section so as to control a flow condition of the etching solution within said flow region between the facing surfaces of said first and second walls.

33. An electrochemical etching system as claimed in claim 29, further comprising:

means for forming a plurality of flow channels which are similar in shape to said flow region so as to simultaneously etch a plurality of said semiconductor substrates, said flow channels being formed in said etching solution holding means;

third and fourth walls which are similar respectively to said first and second walls, each flow channel being defined between said third and fourth walls; and a counter electrode mounted on a surface of said fourth wall, said third wall adapted to receive another semiconductor substrate, said surfaces facing with each other.

34. An electrochemical etching system as claimed in claim 33, further comprising:

means for monitoring an electric potential of at least one semiconductor substrate; and means for controlling an electric potential to be applied between each of the other semiconductor substrates and the corresponding counter electrode, in accordance with the monitored electric potential, so as to simultaneously etch a plurality of the semiconductor substrates.

35. An electrochemical etching system as claimed in claim 33, further comprising:

means for locating said flow stream generating section at a central part of said vessel;

means for locating said flow region and said flow channels around said flow stream generating section; and a bottom wall located below said flow stream generating section, said bottom wall having a curved surface formed to smoothly guide the etching solution from said flow stream generating section toward said flow region and said flow channels.

36. An electrochemical etching system as claimed in claim 29, further comprising means for inclining the facing surfaces of said first and second walls relative to a vertical plane.

37. An electrochemical etching system as claimed in claim 29, wherein the etching solution causing means includes causing the etching solution to flow upwardly through said flow region between the facing surfaces of said first and second walls.

38. An electrochemical etching system as claimed in claim 29, further comprising a holder for the semiconductor substrate, disposed at a position on the surface of said first wall.

39. An electrochemical etching process comprising the following steps:

providing first and second walls which have respectively surfaces defining therebetween a flow region of an etching solution, the surfaces of said first and second walls facing and being spaced from each other, the surfaces of said first and second walls being generally parallel with each other;

mounting a semiconductor substrate and a counter electrode on the facing surfaces of said first and second walls, respectively;

causing the etching solution to flow through said flow region in a direction generally parallel with the facing surfaces of said first and second walls; and applying an electric potential between said semiconductor substrate and said counter electrode;

wherein said electrochemical etching process further comprises:

forming said first and second walls in a vessel to be filled with the etching solution;

forming a section for generating a flow stream of the etching solution in said vessel, said flow stream generating section being connected with said flow region of the etching solution;

providing a partition wall between said flow stream generating section and said flow region of the etching solution; and generating the flow stream of the etching solution at said flow stream generating section.

40. An electrochemical etching process as claimed in claim 39, further comprising the step of controlling a magnitude of flow stream generation of said flow stream generating section so as to control a flow condition of the etching solution within said flow region between the facing surfaces of said first and second walls.

41. An electrochemical etching process as claimed in claim 39, further comprising the step of forming a plurality of flow channels which are similar in shape to said flow region so as to simultaneously etch a plurality of said semiconductor substrates, each flow channel being defined between third and fourth walls which are similar respectively to said first and second walls, a semiconductor substrate and a counter electrode being mounted respectively on surfaces of said third and fourth walls, said surfaces facing with each other.

42. An electrochemical etching process as claimed in claim 41, further comprising the following steps:

monitoring an electric potential of at least one semiconductor substrate; and controlling an electric potential to be applied between each of the other semiconductor substrates and the corresponding counter electrode, in accordance with the monitored electric potential, so as to simultaneously etch a plurality of the semiconductor substrates.

43. An electrochemical etching process as claimed in claim 41, further comprising the following steps:

locating said flow stream generating section at a central part of said vessel;

locating said flow region and flow channels around said flow stream generating section; and providing a bottom wall located below said flow stream generating section, said bottom wall having a curved surface formed to smoothly guide the etching solution from said flow stream generating section toward said flow region and said flow channels.

44. An electrochemical etching process comprising the following steps:

providing first and second walls which have respectively surfaces defining therebetween a flow region of an etching solution, the surfaces of said first and second walls facing and being spaced from each other, the surfaces of said first and second walls being generally parallel with each other;

mounting a semiconductor substrate and a counter electrode on the facing surfaces of said first and second walls, respectively, the semiconductor substrate mounting step including providing a holder for the semiconductor substrate, installing the semiconductor substrate to said holder, and installing said holder at a position on the surface of said first wall;

preventing a second surface of said semiconductor substrate from contacting with the etching solution, said second surface being opposite to a first surface of said semiconductor substrate to be etched;

circulating the etching solution to flow through said flow region in a direction generally parallel with the facing surfaces of said first and second walls; and applying an electric potential between said semiconductor substrate and said counter electrode.

45. An electrochemical etching process comprising the following steps:

providing first and second walls which have respectively surfaces defining therebetween a flow region of an etching solution, the surfaces of said first and second walls facing and being spaced from each other, the surfaces of said first and second walls being generally parallel with each other;

mounting a semiconductor substrate and a counter electrode on the facing surfaces of said first and second walls, respectively; and circulating the etching solution through said flow region and another region at which means for generating flow of the etching solution is disposed, in a manner to cause the etching solution to flow in a direction generally parallel with the facing surfaces of said first and second walls; and applying an electric potential between said semiconductor substrate and said counter electrode.

* * * * *